US008627958B2

(12) United States Patent
McDonald et al.

(10) Patent No.: US 8,627,958 B2
(45) Date of Patent: Jan. 14, 2014

(54) SUSPENSION PACKAGING SYSTEM

(75) Inventors: John McDonald, Fallbrook, CA (US); Frank Comerford, Laguna Niguel, CA (US); Myles Comerford, Rancho Sante Fe, CA (US)

(73) Assignee: Clearpak, LLC, Tustin, CA (US)

( * ) Notice: Subject to any disclaimer, the term of this patent is extended or adjusted under 35 U.S.C. 154(b) by 8 days.

(21) Appl. No.: 12/497,474

(22) Filed: Jul. 2, 2009

(65) Prior Publication Data

US 2010/0140333 A1 Jun. 10, 2010

Related U.S. Application Data

(60) Provisional application No. 61/077,765, filed on Jul. 2, 2008.

(51) Int. Cl.
*B65D 81/07* (2006.01)

(52) U.S. Cl.
USPC ..... 206/583; 206/594

(58) Field of Classification Search
USPC ..... 206/583, 521, 594, 586, 593, 591, 701, 206/719, 721
See application file for complete search history.

(56) References Cited

U.S. PATENT DOCUMENTS

| | | | |
|---|---|---|---|
| 1,821,692 | A | 9/1931 | Copeland |
| 2,161,128 | A | 6/1939 | Boyle |
| 2,746,665 | A | 4/1950 | Wiggins |
| 2,948,455 | A | 8/1960 | Frankenstein |
| 2,956,672 | A | 10/1960 | Kirkpatrick |
| 3,047,137 | A | 7/1962 | Kindseth |
| 3,089,631 | A | 5/1963 | Tyrseck et al. |
| 3,326,410 | A | 6/1967 | Asenbauer |
| 3,345,643 | A | 10/1967 | Bradley |
| 3,434,650 | A | 3/1969 | Goings |
| 3,695,421 | A | 10/1972 | Wood |

(Continued)

FOREIGN PATENT DOCUMENTS

| | | |
|---|---|---|
| DE | 299 21 203 U1 | 2/2000 |
| DE | 101 05 487 A1 | 8/2002 |

(Continued)

OTHER PUBLICATIONS

Co-pending U.S. Appl. No. 10/726,256, filed Dec. 2, 2003 Title: Suspension Packaging Assembly.

(Continued)

*Primary Examiner* — Andrew Perreault
(74) *Attorney, Agent, or Firm* — Knobbe, Martens, Olson & Bear, LLP

(57) ABSTRACT

A packaging assembly can include a container comprising a top, a bottom and a plurality of sidewalls, a first frame and a second frame. The first frame can include a first support panel including a first surface configured to face an article and a second surface opposite to the first surface, and a first leg portion pivotably connected to the first support panel and located between the first support panel and the bottom. The first leg portion can cause a resilient force to bias the first support panel away from the bottom when the first leg portion is located at a third rotational position between the first rotational position and the second rotational position. The second frame can include a second support panel. The second frame can nest with the first frame within the container so as to retain an article between the first and second support panels.

20 Claims, 23 Drawing Sheets

(56) References Cited

U.S. PATENT DOCUMENTS

| | | | |
|---|---|---|---|
| 3,853,220 | A | 12/1974 | Luray |
| 3,854,650 | A | 12/1974 | Hanaue |
| 3,899,119 | A | 8/1975 | Roccaforte |
| 3,905,474 | A | 9/1975 | Haibara |
| 3,917,108 | A | 11/1975 | Thurman |
| 3,994,433 | A | 11/1976 | Jenkins et al. |
| 4,034,908 | A | 7/1977 | Forbes et al. |
| 4,077,518 | A | 3/1978 | Kisslinger et al. |
| 4,155,453 | A | 5/1979 | Ono |
| 4,335,817 | A | 6/1982 | Bahr |
| 4,606,460 | A | 8/1986 | Luray |
| 4,852,743 | A | 8/1989 | Ridgeway |
| 4,886,299 | A | 12/1989 | Ducorday |
| 4,923,065 | A | 5/1990 | Ridgeway |
| 5,024,536 | A | 6/1991 | Hill |
| 5,029,900 | A | 7/1991 | Axelrod |
| 5,046,659 | A | 9/1991 | Warburton |
| 5,056,665 | A | 10/1991 | Boecker et al. |
| 5,071,009 | A | 12/1991 | Ridgeway |
| 5,076,436 | A | 12/1991 | Bortolani et al. |
| 5,080,497 | A | 1/1992 | Peppiatt |
| 5,183,159 | A | 2/1993 | Hojnacki et al. |
| 5,207,327 | A | 5/1993 | Brondos |
| 5,211,290 | A | 5/1993 | Janus et al. |
| 5,218,510 | A | 6/1993 | Bradford |
| 5,223,121 | A | 6/1993 | Dickie et al. |
| 5,226,542 | A | 7/1993 | Boecker et al. |
| 5,226,734 | A | 7/1993 | Scott et al. |
| 5,251,760 | A | 10/1993 | Smith et al. |
| 5,323,896 | A | 6/1994 | Jones |
| 5,372,257 | A | 12/1994 | Beauchamp et al. |
| 5,388,701 | A | 2/1995 | Ridgeway |
| 5,394,985 | A | 3/1995 | Van Hest |
| 5,405,000 | A | 4/1995 | Hagedon et al. |
| 5,492,223 | A | 2/1996 | Boardman et al. |
| 5,579,917 | A | 12/1996 | Lofgren et al. |
| 5,641,068 | A | 6/1997 | Warner |
| 5,669,506 | A | 9/1997 | Lofgren et al. |
| 5,676,245 | A | 10/1997 | Jones |
| 5,678,695 | A | 10/1997 | Ridgeway |
| 5,694,744 | A | 12/1997 | Jones |
| 5,722,541 | A | 3/1998 | Lofgren et al. |
| 5,738,218 | A | 4/1998 | Gonzales |
| 5,769,235 | A | 6/1998 | Keach et al. |
| 5,788,081 | A | 8/1998 | Bates et al. |
| 5,797,493 | A | 8/1998 | Watson |
| 5,803,267 | A | 9/1998 | Tu et al. |
| 5,823,348 | A | 10/1998 | Phillips et al. |
| 5,823,352 | A | 10/1998 | Mena et al. |
| 5,893,462 | A | 4/1999 | Ridgeway |
| 5,894,932 | A | 4/1999 | Harding et al. |
| 5,954,203 | A | 9/1999 | Marconi |
| 5,967,327 | A | 10/1999 | Jones |
| RE36,412 | E | 11/1999 | Jones |
| 5,975,307 | A | 11/1999 | Harding et al. |
| 5,988,387 | A | 11/1999 | Staal et al. |
| 6,006,917 | A | 12/1999 | Loeffler |
| 6,010,003 | A | 1/2000 | Wilkinson |
| 6,047,831 | A | 4/2000 | Jones |
| 6,073,761 | A | 6/2000 | Jones |
| 6,079,563 | A | 6/2000 | Katchmazenski |
| 6,119,863 | A | 9/2000 | Lofgren et al. |
| 6,148,591 | A | 11/2000 | Ridgeway et al. |
| 6,158,589 | A | 12/2000 | Smith et al. |
| 6,206,194 | B1 | 3/2001 | Beneroff et al. |
| 6,223,901 | B1 | 5/2001 | Lofgren et al. |
| 6,289,655 | B1 | 9/2001 | Ridgeway et al. |
| 6,311,843 | B1 | 11/2001 | Smith et al. |
| 6,311,844 | B1 | 11/2001 | Ridgeway et al. |
| 6,398,412 | B2 | 6/2002 | Wedi et al. |
| 6,467,624 | B1 | 10/2002 | Lofgren et al. |
| 6,488,153 | B1 | 12/2002 | Morris |
| 6,675,973 | B1 | 1/2004 | McDonald et al. |
| 6,676,293 | B2 | 1/2004 | Ferris |
| 6,899,229 | B2 | 5/2005 | Dennison et al. |
| 6,920,981 | B2 | 7/2005 | Lofgren et al. |
| 6,942,101 | B2 | 9/2005 | Lofgren et al. |
| 7,000,774 | B2 | 2/2006 | Bryant |
| 7,086,534 | B2 | 8/2006 | Roesel et al. |
| 7,150,356 | B2 | 12/2006 | Lofgren et al. |
| 7,290,662 | B2 | 11/2007 | Lofgren et al. |
| 7,293,695 | B2 | 11/2007 | Stier |
| 7,296,681 | B2 | 11/2007 | McDonald et al. |
| 7,299,926 | B2 * | 11/2007 | Russell et al. ..... 206/583 |
| 7,654,391 | B2 | 2/2010 | Langer et al. |
| 7,669,716 | B2 * | 3/2010 | Lightner et al. ..... 206/583 |
| 7,731,032 | B2 | 6/2010 | McDonald et al. |
| 7,743,924 | B2 | 6/2010 | McDonald et al. |
| 7,753,209 | B2 | 7/2010 | McDonald et al. |
| 7,775,367 | B2 | 8/2010 | McDonald et al. |
| 7,882,956 | B2 | 2/2011 | McDonald et al. |
| 7,931,151 | B2 | 4/2011 | McDonald et al. |
| 8,028,838 | B2 | 10/2011 | McDonald et al. |
| 8,123,039 | B2 | 2/2012 | McDonald et al. |
| 8,177,067 | B2 | 5/2012 | McDonald et al. |
| 8,235,216 | B2 | 8/2012 | McDonald et al. |
| 2001/0047950 | A1 | 12/2001 | Beneroff et al. |
| 2003/0034273 | A1 | 2/2003 | Auclair |
| 2003/0209463 | A1 | 11/2003 | Halpin |
| 2003/0213717 | A1 | 11/2003 | Kanai |
| 2003/0234207 | A1 | 12/2003 | Koike |
| 2004/0108239 | A1 | 6/2004 | McDonald et al. |
| 2004/0178113 | A1 | 9/2004 | Lofgren et al. |
| 2005/0011807 | A1 | 1/2005 | Dennison et al. |
| 2005/0121354 | A1 | 6/2005 | Gillis et al. |
| 2005/0286816 | A1 | 12/2005 | Laske |
| 2006/0000743 | A1 | 1/2006 | Lofgren et al. |
| 2006/0042995 | A1 | 3/2006 | McGrath et al. |
| 2006/0102515 | A1 | 5/2006 | McDonald et al. |
| 2006/0138018 | A1 | 6/2006 | McDonald et al. |
| 2006/0213803 | A1 | 9/2006 | Saitou et al. |
| 2006/0285777 | A1 | 12/2006 | Howell et al. |
| 2007/0080095 | A1 | 4/2007 | McDonald et al. |
| 2007/0251854 | A1 | 11/2007 | McDonald et al. |
| 2008/0067103 | A1 | 3/2008 | McDonald et al. |
| 2008/0099368 | A1 | 5/2008 | McDonald et al. |
| 2008/0110788 | A1 | 5/2008 | Keiger |
| 2008/0110794 | A1 | 5/2008 | Anderson et al. |
| 2008/0128316 | A1 | 6/2008 | McDonald et al. |
| 2008/0223750 | A1 | 9/2008 | McDonald et al. |
| 2009/0272667 | A1 | 11/2009 | McDonald et al. |
| 2010/0140333 | A1 | 6/2010 | McDonald et al. |
| 2010/0276330 | A1 | 11/2010 | McDonald et al. |
| 2010/0307111 | A1 | 12/2010 | McDonald et al. |
| 2011/0259787 | A1 | 10/2011 | McDonald et al. |

FOREIGN PATENT DOCUMENTS

| | | | |
|---|---|---|---|
| EP | 1 561 693 | A1 | 8/2005 |
| JP | 5-305956 | | 11/1993 |
| SU | 827346 | A1 | 5/1981 |
| WO | 00/53499 | A2 | 9/2000 |

OTHER PUBLICATIONS

Co-pending U.S. Appl. No. 11/412,693, filed Apr. 27, 2006 Title: Suspension Packaging Assembly.

Co-pending U.S. Appl. No. 11/606,470, filed Nov. 30, 2006 Title: Suspension Packaging Assembly.

Co-pending U.S. Appl. No. 11/633,712, filed Dec. 5, 2006 Title: Suspension Packaging Assembly.

Co-pending U.S. Appl. No. 11/687,443, filed Mar. 16, 2007 Title: Suspension Package Assembly.

Co-pending U.S. Appl. No. 11/943,514, filed Nov. 20, 2007 Title: Suspension Packaging System.

Co-pending U.S. Appl. No. 11/965,591, filed Dec. 27, 2007 Title: Suspension Packaging System.

Co-pending U.S. Appl. No. 12/508,473, filed Jul. 23, 2009 Title: Suspension Packaging Assembly.

* cited by examiner

SUSPENSION PACKAGING SYSTEM

RELATED APPLICATIONS

This application claims priority to U.S. Provisional Patent Application No. 61/077,765, titled SUSPENSION PACKAGING ASSEMBLY, filed Jul. 2, 2008, the entire contents of which is hereby expressly incorporated by reference.

BACKGROUND OF THE INVENTIONS

1. Field of the Inventions

The present inventions are directed to packaging systems, for example, suspension packaging systems that includes a plurality of foldable members.

2. Description of the Related Art

Protective packaging devices are often used to protect goods from shocks and impacts during shipping or transportation. For example, when transporting articles that are relatively fragile, it is often desirable to cushion the article inside a box to protect the article from a physical impact with the inner walls of the box that might be caused by shocks imparted to the box during loading, transit, and unloading.

In most cases, some additional structure is used to keep the article from moving uncontrollably within the box. Such additional structures include paper or plastic packing material, structured plastic foams, foam-filled cushions, and the like. Ideally, the article to be packaged is suspended within the box so as to be spaced from at least some of the walls of the box, thus protecting the article from other foreign objects which may impact or compromise the outer walls of the box.

U.S. Pat. No. 6,675,973 discloses a number of inventions directed to suspension packaging assemblies which incorporate frame members and one or more retention members. For example, at least one of the embodiments of the U.S. Pat. No. 6,675,973 patent includes the use of a foldable member of a substantially rigid board, for example, a cardboard. The foldable member includes foldable portions configured to form a frame member. Additionally, a retention member formed of a resilient material is used. Some of the retention members include pockets at opposite ends thereof.

SUMMARY OF THE INVENTIONS

One aspect of at least one of the inventions disclosed herein includes the realization of suspension packaging assemblies can be constructed in a manner so as to provide sufficient cushioning without any plastic or plastic-like materials yet provide sufficient cushioning for delicate items and provide convenient and easy un-packing and/or re-packaging. Additionally, another aspect includes the realization that such suspension packaging assemblies can also be constructed such that additional resilient plastic materials can optionally be used with the packing structure to provide additional cushioning if desired, thereby providing two modes of use. Such packaging systems can be particularly advantageous, for example, to a rental business of electronic devices or a business providing repair services requiring shipping of delicate components back and forth between the owner and service provider In accordance with an embodiment, a packaging assembly for packaging an article and maintaining the article therein, the assembly can comprise: a container comprising a top, a bottom and a plurality of sidewalls; a first frame contained within the container, the first frame comprising a first support panel comprising a first surface configured to face an article and a second surface opposite to the first surface, and a first leg portion pivotably connected to the first support panel and located between the first support panel and the bottom, wherein the first leg portion is rotatable relative to the first support panel between a first rotational position and a second rotational position so as to allow movement of the first support panel relative to the bottom, wherein the first leg portion is configured to cause a resilient force to bias the first support panel away from the bottom when the first leg portion is located at a third rotational position between the first rotational position and the second rotational position; and a second frame comprising a second support panel, the second frame being configured to nest with the first frame within the container so as to retain an article between the first and second support panels.

In the foregoing embodiment, the first frame can further comprise a first anchor panel extending between the top and bottom of the container; and a first connecting portion interconnecting the first support panel and the first anchor panel and comprising at least one fold line configured to allow movement of the first support panel relative to the bottom of the container. The first connecting portion can comprise at least two panels pivotably connected to each other along the at least one fold line.

Still in the foregoing embodiment, the first connecting portion can comprise a first side panel pivotally connected to the first support panel, and a ridge panel pivotably connected to each of the first anchor panel and the first side panel, wherein the first anchor panel and the first side panel are substantially parallel to each other. The first frame further can comprise: a second anchor panel extending between the top and the bottom of the container; and a second connecting portion interconnecting the first support panel and the second anchor panel and comprising at least one fold line configured to allow movement of the first support panel relative to the bottom of the container. The first frame can further comprise a second connecting portion interconnecting the first support panel and one of the plurality of sidewalls of the container and comprising at least one fold line configured to allow movement of the first support panel relative to the bottom of the container.

Yet in the foregoing embodiment, the first leg portion can comprise a distal end contacting the bottom and configured to slide with respect to the bottom when the first leg portion moves between the first and second rotational positions. The first frame can further comprise a second leg portion pivotably connected to the first support panel such that the first support panel is interposed between the first and second leg portions.

Further in the foregoing embodiment, the second support panel of the second frame can comprise at least one foldable flap configured to resiliently support an article retained between the first and second frames. The second frame can be sized such that the second frame substantially fits into a space defined by the container and first frame. The assembly can further comprise a retention member which comprises a resilient body and an end portion configured to engage with the at least one folded portion such that the resilient body disposed over the second support panel, wherein the resilient body is configured to resiliently support an article retained between the first and second frames. The assembly may have no resilient retention sheet member configured to engage with one of the first and second frames. The assembly can be configured to provide substantial cushioning without a resilient retention sheet member configured to engage with one of the first and second frames.

The second frame can comprise a third leg portion pivotably connected to the second support panel and located between the second support panel and the top, wherein the third leg portion is rotatable relative to the second support panel between a first rotational position and a second rotational position so as to allow movement of the second support panel relative to the top, wherein the third leg portion is configured to cause a resilient force to bias the second support panel away from the top when the third leg portion is located at a third rotational position between the first rotational position and the second rotational position. The container and the first frame can be pivotably connected to each other and are formed of a single cardboard.

In another embodiment, a packaging kit for packaging an article and maintaining the article can comprise: a container forming member comprising a plurality of foldable portions configured to form a container which comprises a top, a bottom and a plurality of sidewalls; a first frame forming member comprising a plurality of foldable portions configured to form a first frame to be contained within the container, wherein the first frame comprises a first support panel comprising a first surface configured to face an article and a second surface opposite to the first surface, and a first leg portion pivotably connected to the first support panel and configured to be located between the first support panel and the bottom, wherein the first leg portion is rotatable relative to the first support panel between a first rotational position and a second rotational position so as to allow movement of the first support panel relative to the bottom, wherein the first leg portion is configured to cause a resilient force to bias the first support panel away from the bottom when the first leg portion is located at a third rotational position between the first rotational position and the second rotational position; and a second frame forming member comprising a plurality of foldable portions and configured to form a second frame which comprises a second support panel and at least one side panel connected to the second support panel, the second frame being configured to nest with the first frame within the container so as to retain an article between the first and second support panels.

In the foregoing embodiment, the first frame can further comprise: a first anchor panel extending between the top and bottom of the container when the first frame is contained in the container; and a first connecting portion interconnecting the first support panel and the first anchor panel and comprising at least one fold line configured to allow movement of the first support panel relative to the bottom of the container. The first connecting portion can comprise a first side panel pivotally connected to the first support panel and a ridge panel pivotably connected to each of the first anchor panel and the first side panel, wherein the first anchor panel and the first side panel are substantially parallel to each other.

Still in the foregoing embodiment, the first frame can further comprise: a second anchor panel extending between the top and the bottom of the container when the first frame is contained in the container; and a second connecting portion interconnecting the first support panel and the second anchor panel and comprising at least one fold line configured to allow movement of the first support panel relative to the bottom of the container.

Still in another embodiment, a packaging kit for packaging an article and maintaining the article can comprise: a first foldable member comprising a plurality of foldable portions, the first foldable member being configured to form a container which comprises a top, a bottom and a plurality of sidewalls, and further configured to form a first frame to be contained within the container and pivotably connected to the container, wherein the first frame comprises a first support panel comprising a first surface configured to face an article and a second surface opposite to the first surface, and a first leg portion pivotably connected to the first support panel and configured to be located between the first support panel and the bottom, wherein the first leg portion is rotatable relative to the first support panel between a first rotational position and a second rotational position so as to allow movement of the first support panel relative to the bottom, wherein the first leg portion is configured to cause a resilient force to bias the first support panel away from the bottom when the first leg portion is located at a third rotational position between the first rotational position and the second rotational position; and a second foldable member comprising a plurality of foldable portions and configured to form a second frame which comprises a second support panel and at least one side panel connected to the second support panel, the second frame being configured to nest with the first frame within the container so as to retain an article between the first and second support panels.

BRIEF DESCRIPTION OF THE DRAWINGS

These and other features of the inventions are described below with reference to the drawings of several embodiments of the present packaging assemblies and kits which are intended to illustrate, but not to limit, the inventions. The drawings contain the following figures.

DETAILED DESCRIPTION OF EMBODIMENTS

An improved packaging system is disclosed herein. The packaging system includes an improved structure which provides new alternatives to known suspension packaging systems.

In the following detailed description, terms of orientation such as "top," "bottom," "front," "upper," "lower," "longitudinal," "horizontal," "vertical," "lateral," "midpoint," and "end" may be used here to simplify the description in the context of the illustrated embodiments. Because other orientations are possible, however, the present inventions should not be limited to the illustrated orientations. Additionally, the term "suspension" is not intended to require that anything, such as an article to be packaged, is suspended above anything. Rather, the terms "suspended" as used herein, is only intended to reflect that such an article is held in a position spaced from another member, such as at least some of the walls of a container or box. Those skilled in the art will appreciate that other orientations of various components described herein are possible.

Figure 1:
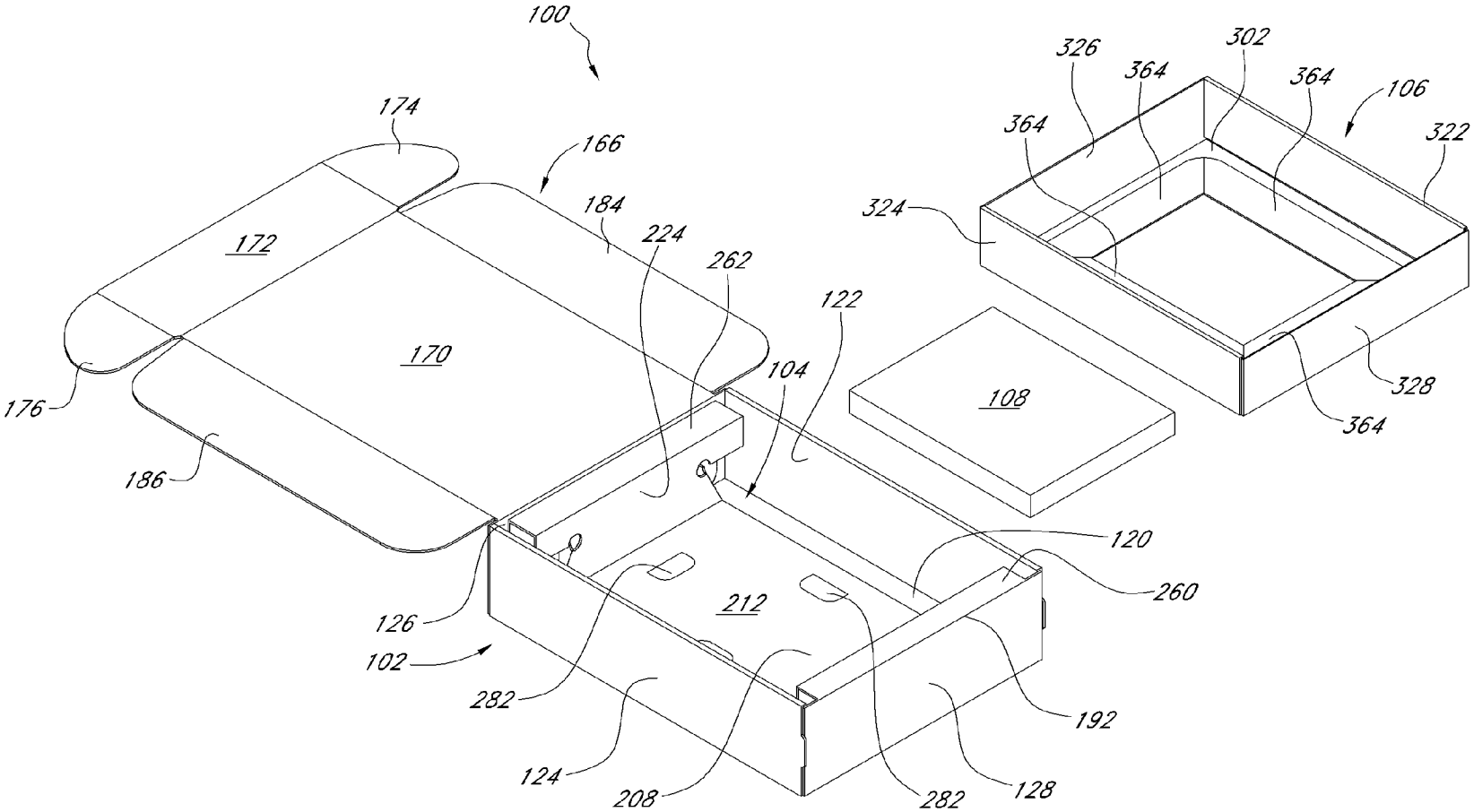
FIG. 1 is an exploded, perspective view of a packaging assembly in accordance with one embodiment along with an article to be packaged.

With reference to FIG. 1, a packaging assembly 100 is constructed in accordance with one embodiment. The packaging assembly 100 includes a container 102, a first suspension support 104 and a second suspension support 106. The container 102 has a cavity or a recess. The suspension supports 104, 106 can nest with each other within the container 102, and support an article 108 to be packaged in a position spaced from at least some of the walls of the container portion 102. In FIG. 1, the first suspension support 104 is contained within the cavity of the container 102. The article 108 is shown to be positioned over the first suspension support 104, and the second suspension support 106 is inserted in the container to nest with the first suspension support 104.

Figure 2:
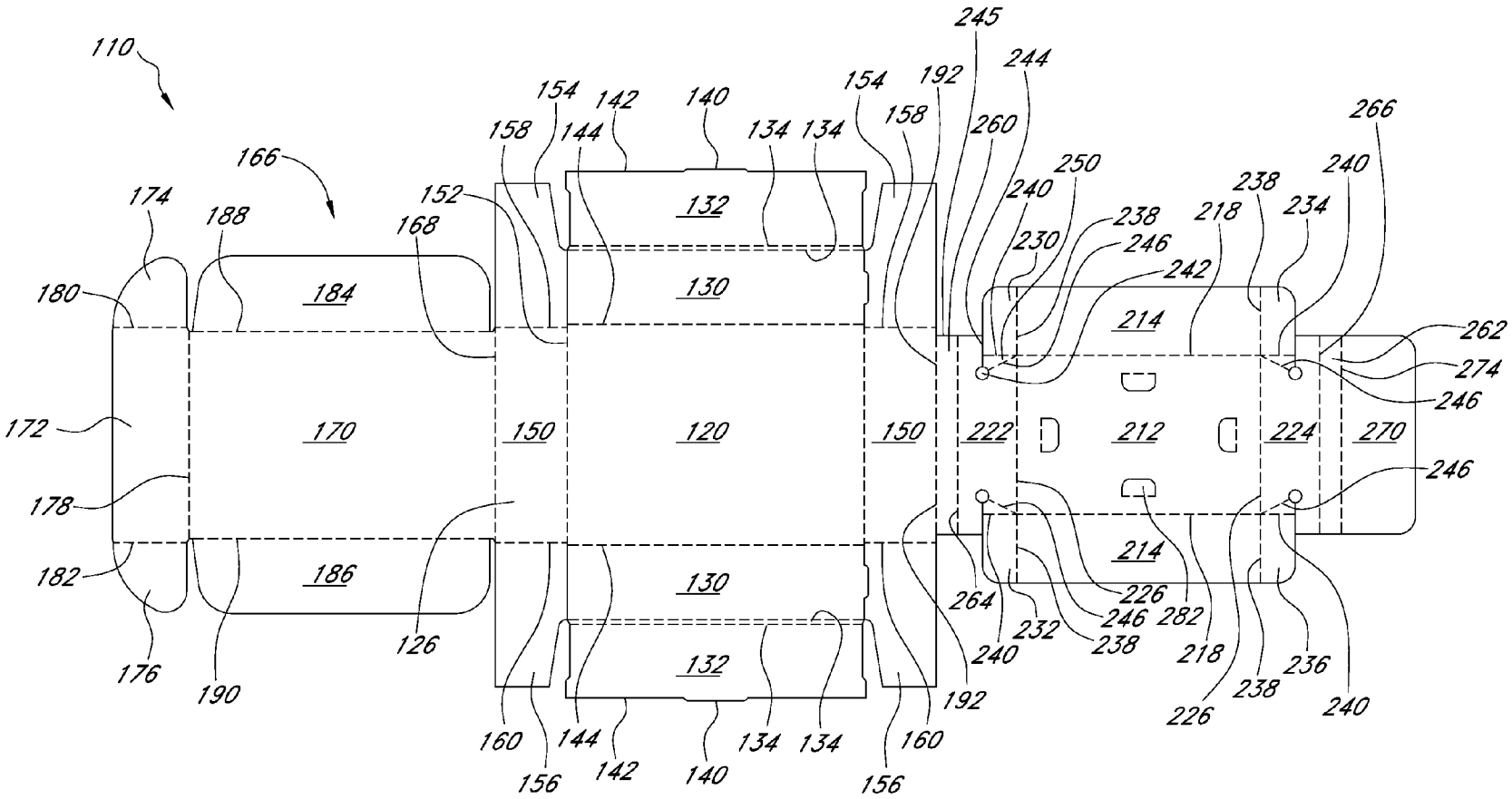
FIG. 2 is a plan view of a first foldable member configured to form a container and a first suspension support shown in FIG. 1, illustrating an unfolded and unassembled state thereof, the first foldable member having folding lines and foldable portions.

Referring to FIG. 2, a first foldable packaging member 110 is illustrated therein in an unfolded state and is constructed in accordance with one embodiment. The foldable member 110 includes a plurality of foldable portions configured to form the container 102 and a first suspension support 104.

A further advantage is provided where, as illustrated in FIGS. 1 and 2, the container portion 102 is connected to the first support portion 104. As such, when manipulated into a folded state, the support portion 104 can be conveniently folded into the cavity of the container portion 102. Additionally, in this embodiment, both the container portion 102 and the suspension portion 104 can be formed from a single piece of material.

In one embodiment, the member 110 can be constructed from various materials, including but without limitation, paper, cardboard, corrugated cardboard, plastic, and other appropriate materials. The chosen material for constructing the member 110 can be any substantially rigid but foldable material. It will be appreciated that, although denominated as rigid or substantially rigid, the chosen material would preferably have an amount of flexibility in the cases of extreme physical impact. In some embodiments, the material used to form the member 110 is a single wall corrugated C-flute cardboard.

Referring to FIGS. 1 and 2, in one embodiment, the member 110 includes two portions foldably connected to each other and configured to form the container 102 and the first suspension support 104, respectively. The container 102 includes a bottom panel 120. The size of the panel 120 can be chosen by one of ordinary skilled in the art to provide the desired amount of surface area of the bottom of the container 102 formed by the member 110. In an example but non-limiting embodiment, where the member 110 is intended to package a handheld communication device, modem or a hard drive, the panel 120 can be about 10 inches square. However, this is merely an embodiment, and the panel member 120 can have other dimensions for use in packaging modems or hard drives, or any other article that is to be packaged.

Still referring to FIGS. 1 and 2, the container 102 can also include lateral walls 122, 124 and end walls 126, 128. For brevity, the construction of the lateral wall portion 122 will be described. However, it is to be understood that the lateral wall portion 124 also can include the same features. The lateral wall 122 has a double wall structure when folded. For this end, the member 110 includes an inner panel 130 and an outer panel 132 configured to form a double wall structure 122. Additionally, the lateral wall 122 can include at least one fold line 134 defined between the inner panel 130 and the outer panel 132. In the illustrated embodiment, the lateral wall portion 122 includes two fold lines 134.

The fold lines 134 can be formed as perforations in the member 110, i.e., broken cut lines passing partially or completely through the material forming the member 110. In the alternative, or in addition, the fold lines can be crushed portions of the material forming the member 110. Of course, depending on the material used to construct the member 110, the fold lines can be formed as mechanical hinges, thinned portions, adhesive tape, or any other appropriate mechanical connection which would allow various portions of the tray member to be folded or rotated with respect to each other. These concepts apply to all the fold lines described herein, although this description will not be repeated with respect to the other fold lines described below. For brevity, the construction of the fold lines 134 has been described above. However, it is to be understood that the other fold lines in the member 110 or other members described in the description also can include the same features.

In the illustrated embodiment, when the lateral wall 122 is folded upwardly and inwardly towards the panel member 120, the inner panel 130 forms an outer wall of the container 102 and the outer panel 132 forms an inner wall. The area between the fold lines 134, identified generally by the reference numeral 138, will form an upper edge of the lateral wall 122.

The lateral wall 122 can also include means for securing the walls in place when folded. For example, in the illustrated embodiment, the outer panel 132 includes a projection 140 on its outermost edge 142. When the lateral wall 122 is completely folded, the projection 140 will rest against the panel member 120 adjacent a fold line 144 defined at the boundary between the bottom portion 120 and the lateral wall 122. The projection 140 is merely one type of configuration that can be provided for securing the lateral wall portion 122 in place. Further, in one embodiment, the panel member 120 can include an aperture for receiving the projection 140.

Still referring to FIGS. 1 and 2, each of the end walls 126, 128 can include a single wall panel 150 connected to the main panel 120 along a fold line 152. For brevity, the construction of the end wall 126 will be described. However, it is to be understood that the end wall portion 128 also can include the same features. The end wall 126 can also include corner flaps 154, 156, connected to the wall panel 150 along fold lines 158, 160.

The end wall 126 is configured such that the panel 150 can be folded towards the bottom portion 120 along the fold line 152. Additionally, the corner flaps 154, 156 can be folded inwardly towards the panel 150, at about a right angle, for example, such that when the panel 150 is folded into an orientation being approximately perpendicular to the bottom portion 120, each of the corner flaps 154, 156 lie along or adjacent to the fold lines 144 between the bottom portion 120 and one of the lateral walls 122, 124. With the corner flaps 154, 156 in this orientation, each of the lateral walls 122, 124 can be folded over the corner flaps 154, 156. As such, for example, each of the corner flaps 154, 156 can be sandwiched between the inner panel 130 and the outer panel 132.

In one embodiment, the container 102 can include a lid portion 166 connected to the end wall 126. The lid 166 can include a top panel 170 connected to the wall panel 150 along the fold line 168. The top panel 170 can be approximately the same size as the bottom panel 120.

Additionally, the lid portion 166 can include a front panel 172 and corner flaps 174, 176. The front panel 172 is connected to the top panel 170 along a fold line 178. Additionally, the corner flaps 174, 176 are attached to the front panel 172 along fold lines 180, 182. Each of the corner flaps 174, 176 are configured to be inserted into a space between the panels 130, 132 of one of the lateral walls 122, 124.

In one embodiment, the lid 166 can include side flaps 184, 186 connected to the top panel 170 along fold lines 188, 190. For brevity, the construction of the side flap 184 will be described. However, it is to be understood that the side flap 186 also can include the same features.

The side flap 184 can be folded inwardly towards the top panel 170, at about a right angle, for example, such that when the panel 170 is folded into an orientation being approximately perpendicular to the end wall 126, the side flap 184 lies along and adjacent the lateral wall portion 122. In one embodiment, a width of the top panel 170 that is a distance between the fold lines 188, 190 is sized such that the side flaps 184, 186 are positioned inside and contact the inner walls of the lateral wall portions 122, 124. Additionally, the side flap 184 is sized such that a distance between the fold line 188 or 190 and a distal end of the side flap 184 or 186 is generally same with or slightly smaller than the height of the lateral wall 122, 124, but not limited thereto.

Figure 5:
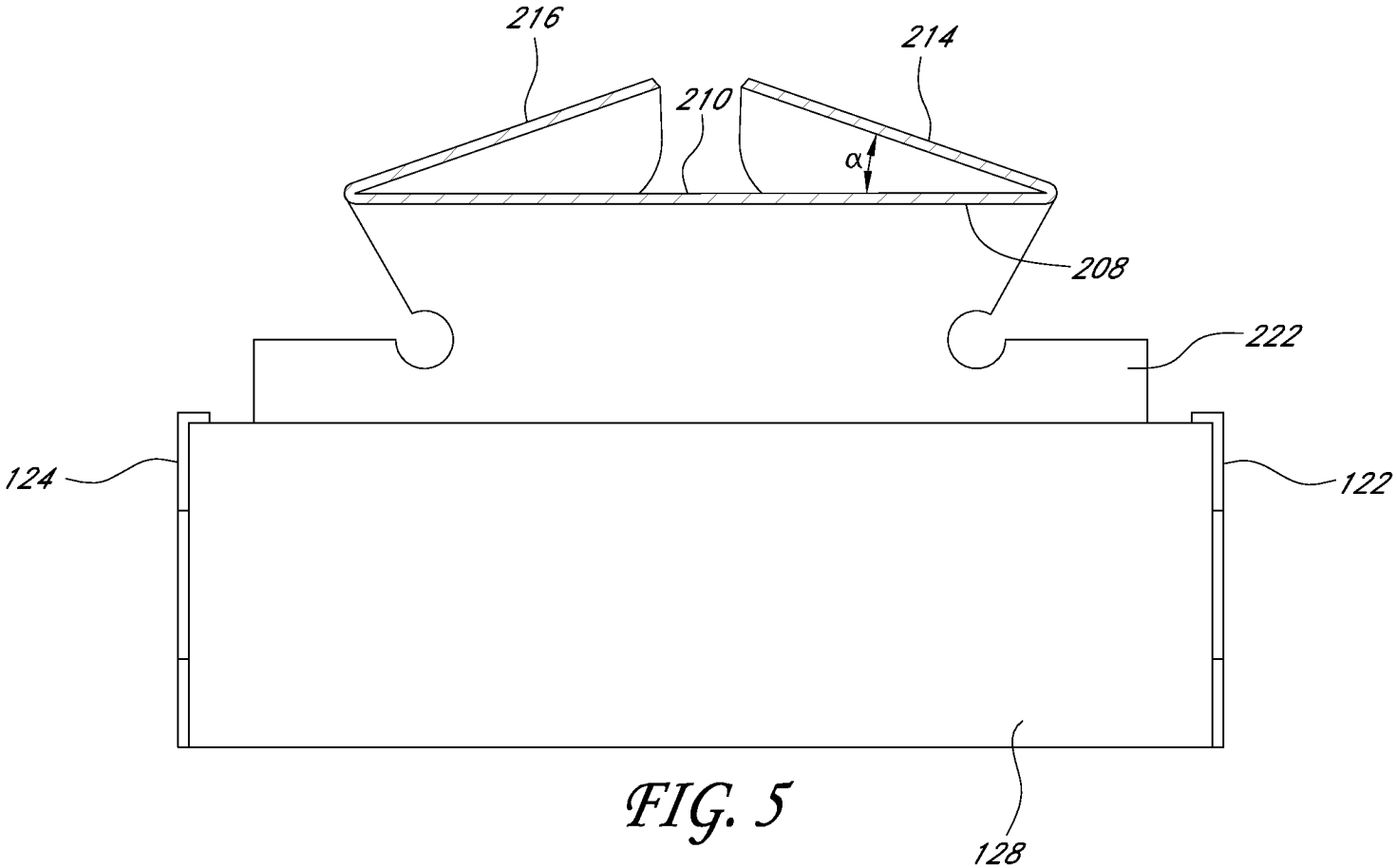
FIG. 5 is a sectional view of the first foldable member taken along line 5-5 of FIG. 4.

With continued reference to FIGS. 1 and 2, in one embodiment, the first suspension support 104 is connected to the end wall 128 along a fold line 192. The first suspension support portion 104 can include a support panel 212 and at least one foldable leg portion pivotally connected to the first article support panel 212. The panel 212 can include a first surface 208 and a second surface 210 opposing the first surface. (See FIGS. 5 and 13) The first surface 208 faces an article 108, when the article is packaged.

In some embodiments, the first suspension support portion 104 can include two foldable leg portions 214, 216 such that the support panel 212 is interposed between the leg portions 214, 216. Each of the foldable leg portions 214, 216 is pivotably connected to the support panel 212 along a fold line 218. Each of the leg portions 214, 216 can be folded towards the second surface 210 to form an angle with respect to the second surface 210 smaller than about 90° such that each of the leg portions 214, 216 provides a spring effect. (See FIGS. 8 and 13).

In one embodiment, the first suspension support 104 can include side panels 222, 224. Each of the side panels 222, 224 is pivotably connected to the support panel 212 along a fold line 226 such that the base panel 212 is interposed between the side panels 222, 224. Each of the side panels 222, 224 can be folded towards the first surface 208 into a generally perpendicular orientation relative to the base panel 212.

Referring to FIG. 2, in some embodiments, the first suspension support portion 104 can include corner panels 230, 232, 234, 236. For brevity, the construction related to the corner panel 230 will be described. However, it is to be understood that the packaging assembly can include the same features for the corner panels 232, 234, 236. The corner panel 230 is connected to both the leg portion 214 and the side panel 222 along fold lines 238, 240, respectively. In one embodiment, the side panels 222 include a hole 242 located near the corner panel 230. As shown in FIG. 2, a cut line 244 extends from a side edge 245 of the side panel 222 to the hole 242. A further fold line 246 can be formed from a corner 248 of the base panel 212 to the hole 242.

The corner panel 230 can be folded along the fold line 238 towards the side panel 222, to form a first folded state of the corner panel 230 when the leg panel 214 is folded towards the second surface 210 of the base panel 212. In this configuration, the corner panel 230 can form an angle smaller than about 90° with respect to the side panel 222. In one embodiment, the corner panel 230 can be further folded along the fold line 240 to form a second folded state of the corner panel 230 when the side panel 222 is folded towards the first surface of the base panel 212. Additionally, in this folded configuration, a delta-shaped portion 250 of the side panel 222 is configured to be folded along the fold lines 246 with respect to a main portion of the side panel 222. This configuration can allow an edge of the corner panel 230 to be spaced from the side panel 222, and provide a spring effect.

In one embodiment, the first suspension support 104 can include ridge portions 260, 262 that are pivotally connected to the side panels 222, 224 along fold lines 264, 266, respectively. The ridge portion 222 is pivotally connected to the end wall 128 of the container 102 along the fold line 192. Additionally, the first suspension support 104 can further include a foldable anchor panel 270 that is connected to the ridge 262 along a fold line 274.

In some embodiments, the ridge portion 260 and the side panel 222 can be folded towards the end wall 128 such that the side 128 and the side panel 222 are generally parallel to each other. Similarly, the ridge portion 262 and the anchor panel 270 can be folded towards the side panel 224 such that the anchor 270 and the side panel 224 are generally parallel to each other.

Figure 3:
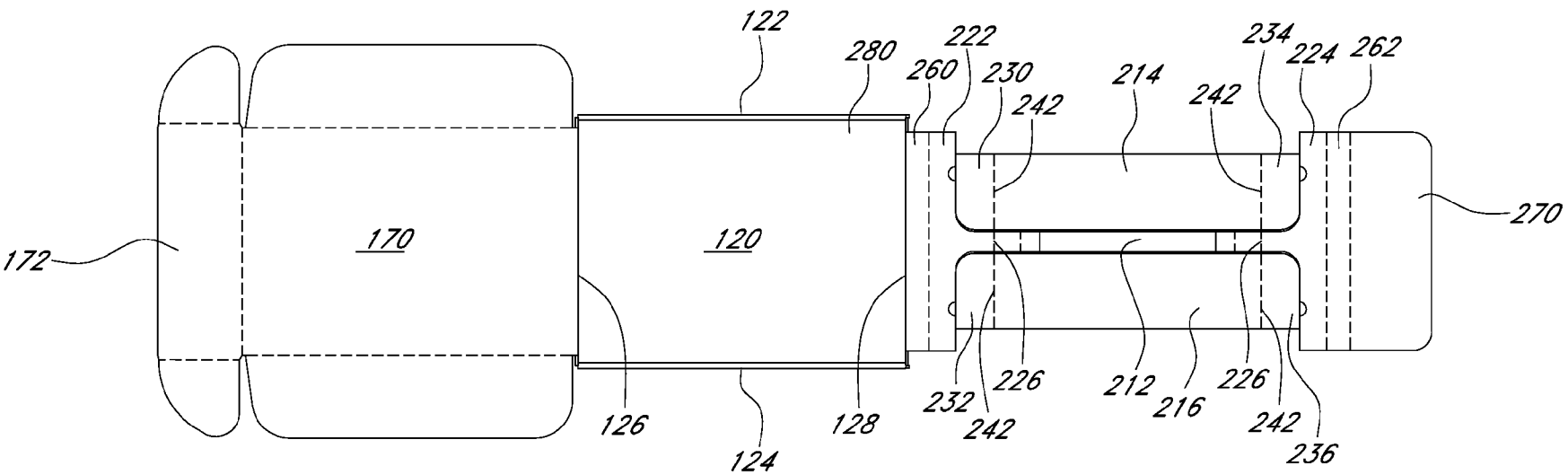
FIG. 3 is a plan view of the first foldable member of FIG. 2 in a first partially folded state.
Figure 4:
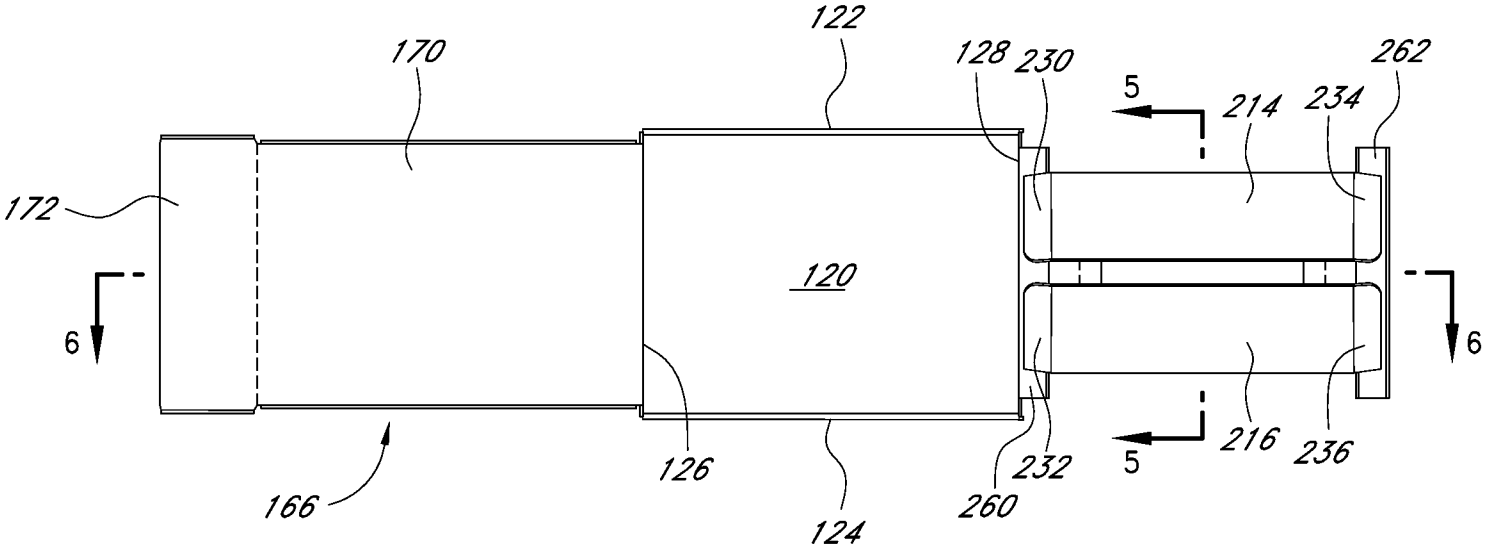
FIG. 4 is a plan view of the first foldable member of FIG. 2 in a second partially folded state.

With reference to FIGS. 2 and 3, when folding the container 102 so as to define a cavity, the corner panels 154, 156 can first be folded upwardly into a generally perpendicular orientation relative to the end walls 126, 128. Then, the walls 126, 128, along with the corner panels 154, 156 attached thereto and folded relative thereto, can be folded upwardly into a generally perpendicular orientation relative to the panel 120. The panels 130, 132 of the lateral wall portions 122, 124 can then be folded so as to enclose the corner panels 154, 156 therein. As shown in FIG. 3, the lateral wall sections 122, 124, now form walls of a cavity 280. Similarly, the end walls 126, 128 form walls of the cavity 280, with the bottom portion 120 forming the bottom thereof. After the formation of the cavity 280 as such, the folded structure of the first suspension support 104 can be inserted in the cavity 280.

FIG. 3 illustrates the ridge portion 262 folded with respect to the end wall 124 into an orientation being approximately perpendicular to the end wall 124 such that the support panel 212 is approximately parallel to the panel 120 of the container 102. However, in another embodiment, the ridge portion 262 is not folded during the formation of the folded structure of the first suspension support 104, which will be described further.

Referring to FIGS. 3 to 6, in one embodiment, the foldable leg portions 214, 216 can be folded until leaving a clearance between the foldable portions 214, 216 and the panel 212 with an angle $\alpha$ smaller than about 90°. This can provide cushioning for an article 108 when an article 108 is packaged. When folding the leg panels 214, 216, the corner panels 230, 232, 234, 236 can be folded with respect to the side panels 222, 224, too.

Subsequently, the side panels 222, 224 can be folded towards the first surface of the support panel 212 to be approximately perpendicular to the support panel. When folding the side panels 222, 224, the corner panels 230, 232, 234, 236 can be folded with respect to the leg panels 214, 216. Further, the portion 250 can be folded along the fold line 246 and provides a clearance between each of the corner panels 230, 232 and the side panel 222 and between each of the corner panels 234, 236 and the side panel 224.

Additionally, the side panel 222 can be folded with respect to the ridge portion 260 into an orientation being approximately perpendicular orientation to the ridge portion 260. Similarly, the side panel 224 can be folded with respect to the ridge portion 262 into an orientation being approximately perpendicular orientation to the ridge portion 262. The anchor panel 270 can be folded towards the side panel 224 with respect to the ridge portion 262 into an orientation being approximately perpendicular orientation to the ridge portion 262. In this folded configuration, the side panel 224 is approximately parallel to the anchor panel 270.

Figure 6:
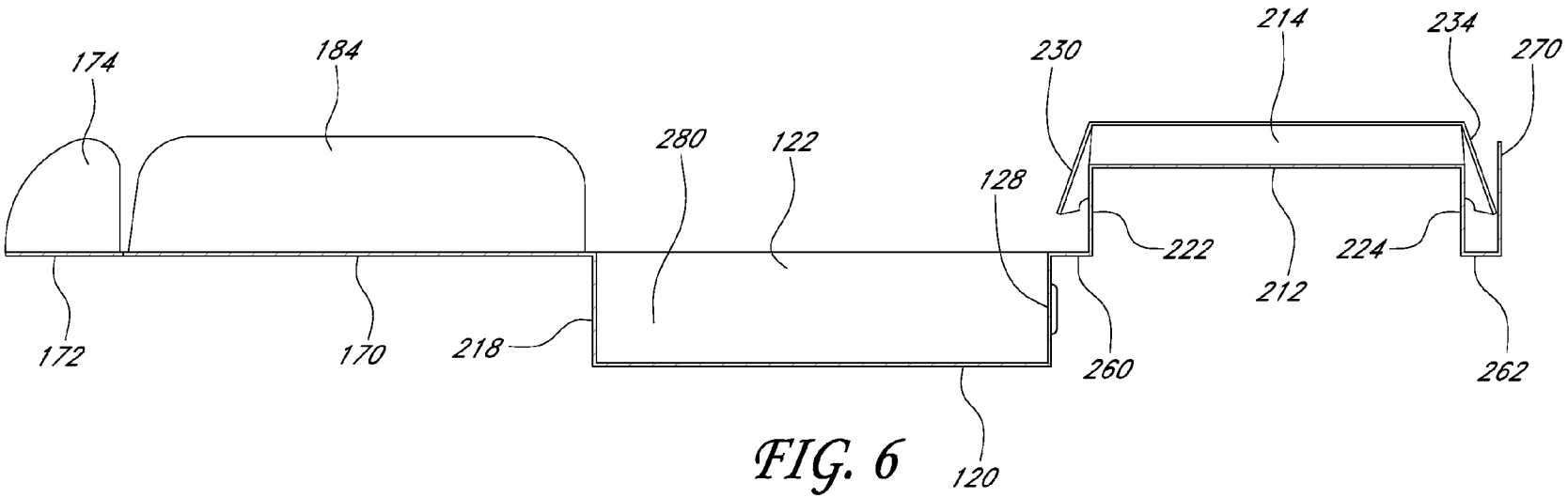
FIG. 6 is a sectional view of the first foldable member taken along line 6-6 of FIG. 4.
Figure 7:
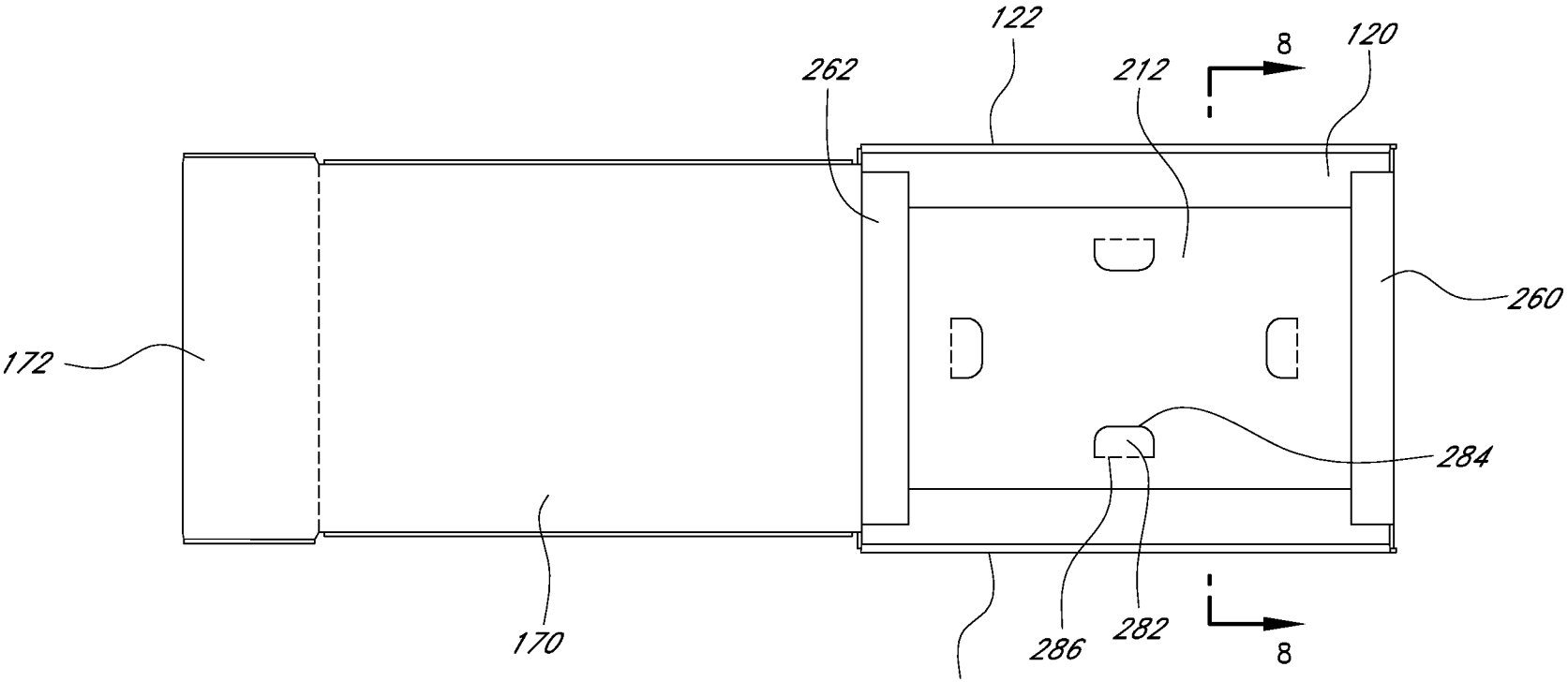
FIG. 7 is a plan view of the first foldable member of FIG. 2 in a third folded state.
Figure 8:
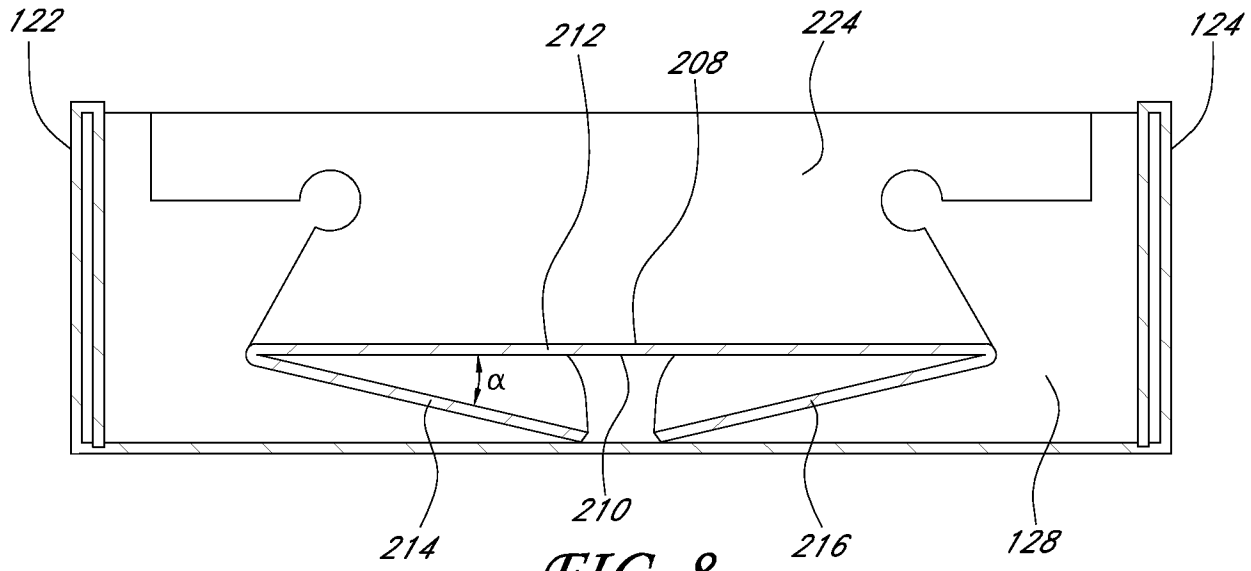
FIG. 8 is a sectional view of the first foldable member taken along line 8-8 of FIG. 7.
Figure 12:
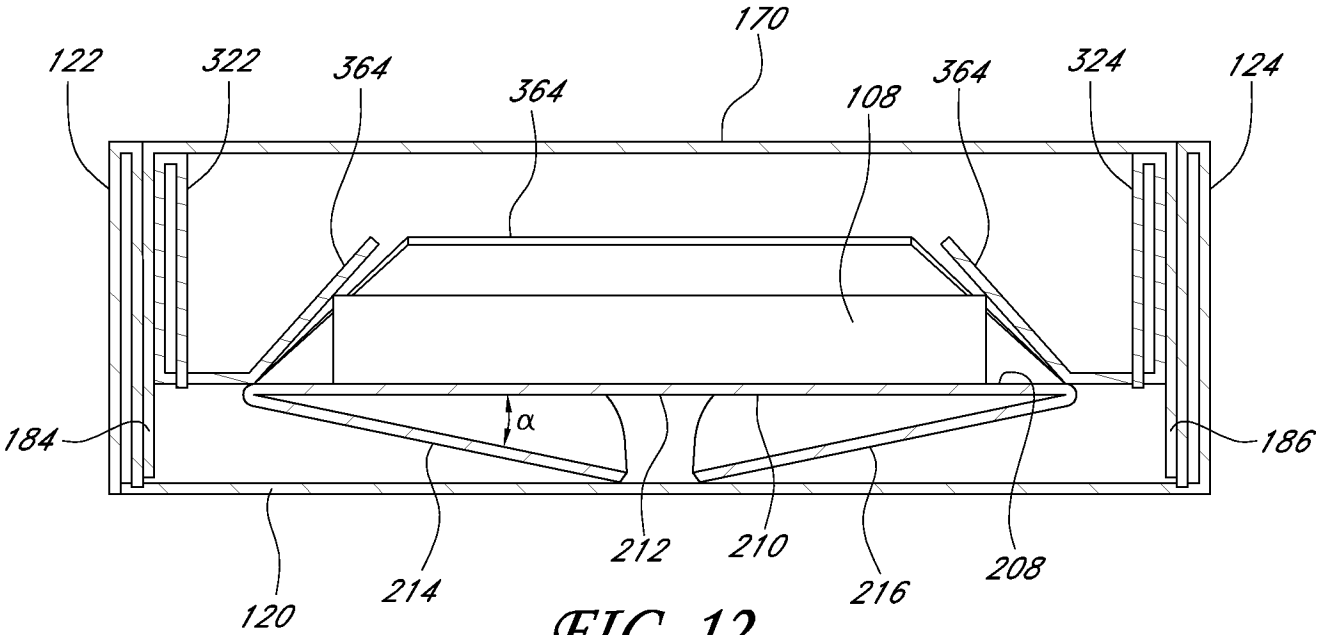
FIG. 12 is a cut-away side elevation view of the packaging assembly with a lid closed, an article being packaged between the first and second suspension supports.

With reference to FIGS. 6 and 7, once the folded formation of the first suspension support 104 is completed, the ridge portion 262 can be folded with respect to the end wall 128 of the container such that the first suspension support 104 is contained in the container 102. As shown in FIG. 8, the legs 214, 216 are positioned between the support panel 212 and the bottom panel 120 of the container. In one embodiment, edges of the leg portions 214, 216 contact the bottom of the container 102 so that the legs 214 resiliently support the support panel 212 and an article 108 that will be disposed over the support panel 212 and suspended within the container. As shown in FIG. 12, in some embodiments, at least a portion of each of the corner panels 130, 132 can be interposed between one of the side panel 222 and the end wall 128. Edges of the corner panels 130, 132 contact the end wall 128. Similarly, in some embodiments, at least a portion of each of the corner panels 134, 136 can be interposed between one of the side panel 222 and the end wall 126. In the illustrated embodiment, edges of the corner panels 130, 132 contact the anchor panel 270.

Figure 10:
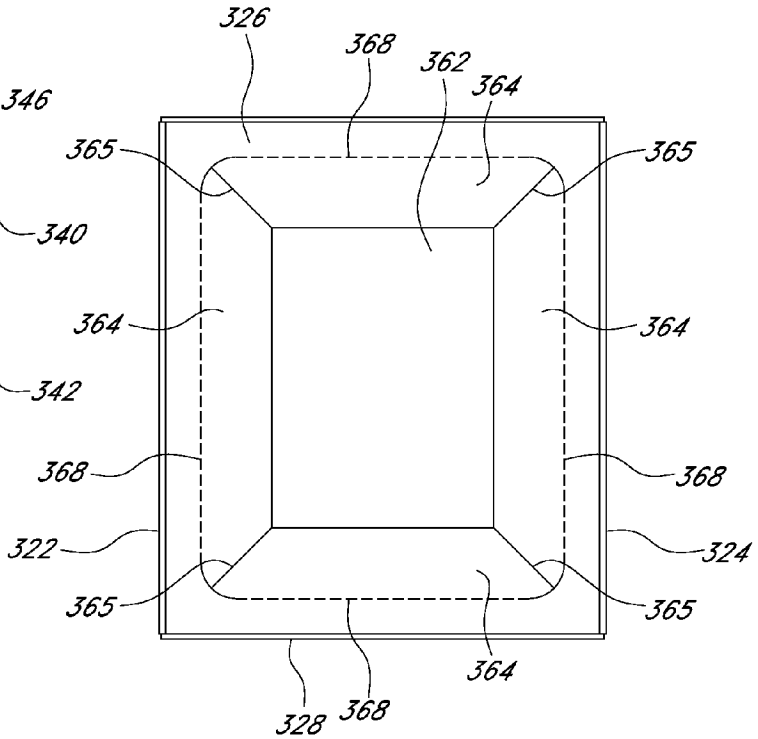
FIG. 10 is a plan view of the second suspension support of FIG. 9 in a folded state.
Figure 9:
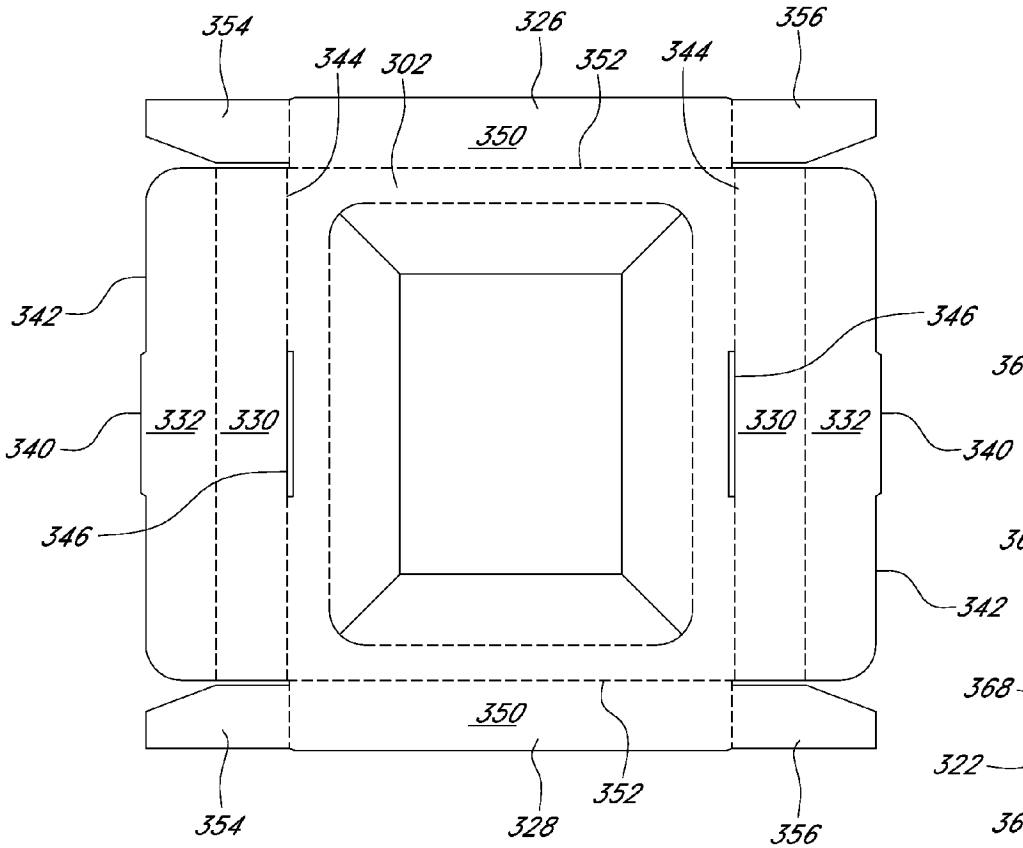
FIG. 9 is a plan view of a second foldable member configured to form a second suspension support shown in FIG. 1, illustrating an unfolded and unassembled state thereof.

Referring to FIGS. 1, 9 and 10, in one embodiment, the second suspension support 106 can be formed by folding a second foldable member 112. As shown in FIG. 10, the member 112 can include a plurality of foldable portions configured to form walls of the second suspension support 106. In one embodiment, similarly to the member 110, the member 112 can be constructed from various materials, including but without limitation, paper, cardboard, corrugated cardboard, plastic, and other appropriate materials. The chosen material for constructing the member 112 can be any substantially rigid but foldable material. It will be appreciated that, although denominated as rigid or substantially rigid, the chosen material would preferably have an amount of flexibility in the cases of extreme physical impact. In some embodiments, the material used to form the member 112 is a single wall corrugated C-flute cardboard.

Figure 11:
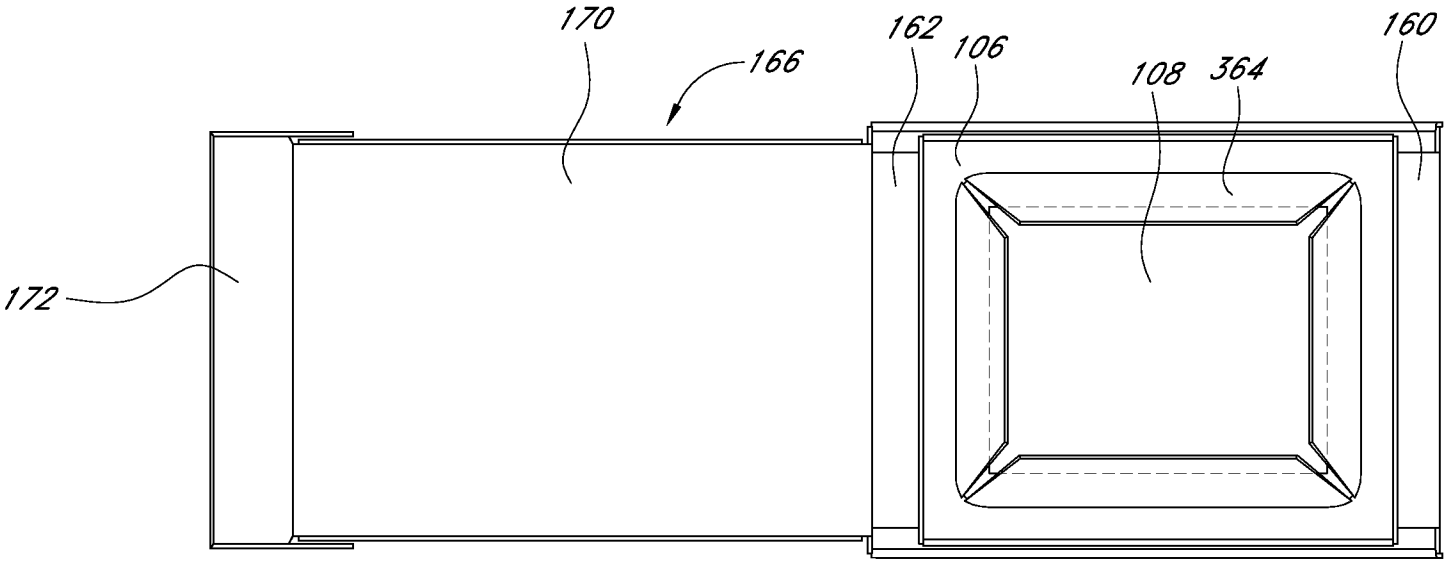
FIG. 11 is a plan view of the packaging assembly shown in FIG. 1, the first and second suspension supports being assembled and an article being located therebetween.

The second suspension support 106 can include a support panel 302. In one embodiment the size of the support panel 302 can be chosen by one of ordinary skilled in the art to allow the second suspension support 106 to nest with the first suspension support 104 shown in FIG. 7. In one embodiment, the size of the support panel 302 can be determined to allow the second suspension support 106 to fit within a space formed between the side panels 222, 224 and further between the side flaps 184, 186. (See FIGS. 11-13.)

Still referring to FIGS. 1, 9 and 10, the second suspension support 106 can also include lateral walls 322, 324 and end walls 326, 328. For brevity, the construction of the lateral wall portion 322 will be described. However, it is to be understood that the lateral wall portion 324 also can include the same features. The lateral wall 322 has a double wall structure when folded. For this end, the member 112 can include an inner panel 330 and an outer panel 332 configured to form a double wall structure 322. Additionally, the lateral wall 322 can include at least one fold line 334 defined between the outer panel 330 and the outer panel 332.

In the illustrated embodiment, when the lateral wall 222 is folded upwardly and inwardly towards the support panel 302, the inner panel 330 forms an outer wall of the second support 106 and the outer panel 332 forms an inner wall. The lateral wall 322 can also include means for securing the walls in place when folded. For example, in the illustrated embodiment, the outer panel 332 can include a projection 340 on its outermost edge 342. When the lateral wall 322 is completely folded, the projection 340 will rest against the support panel 302 adjacent a fold line 344 defined at the boundary between the support panel 302 and the lateral wall 322. Further, in the illustrated embodiment, the support member 302 can include an aperture 346 for receiving the projection 340.

Still referring to FIGS. 1, 9 and 10, each of the end walls 326, 328 can include a single wall panel 350 connected to the main panel 302 along a fold line 352. For brevity, the construction of the end wall 326 will be described. However, it is to be understood that the end wall portion 328 also can include the same features. The end wall 326 can also include corner flaps 354, 356, connected to the wall panel 350 along fold lines 358, 360.

The end wall 326 is configured such that the panel 350 can be folded towards the support panel 302 along the fold line 352. Additionally, the corner flaps 354, 356 can be folded inwardly towards the panel 350, at about a right angle, for example, such that when the panel 350 is folded into an orientation being approximately perpendicular to the support panel 302, each of the corner flaps 354, 356 lie along or adjacent to the fold lines 344 between the support panel 302 and one of the lateral walls 322, 324. With the corner flaps 354, 356 in this orientation, each of the lateral walls 322, 324 can be folded over the corner flaps 354, 356. As such, for example, each of the corner flaps 354, 356 can be sandwiched between the inner panel 330 and the outer panel 332.

With reference to FIGS. 9 and 10, in one embodiment, the support panel 302 can include at least one foldable flap 364. In particular, the support panel 302 can include four pivotable flaps 364 in the illustrated embodiment. To construct the pivotable flaps 364, the support panel 302 can include a rectangular hole 362 at the center portion thereof and cut lines 365. Each of the cut lines 365 extends from a corner of the hole 362 in an approximately diagonal direction. Each of the foldable flaps 364 is formed between two neighboring cut lines 365 and is foldable along a fold line 368. In one embodiment, each of the foldable flaps 364 can be resiliently folded and be restored to the unfolded state. This configuration of the pivotable flaps 364 provides resilient support to an article to be packaged.

Figure 13:
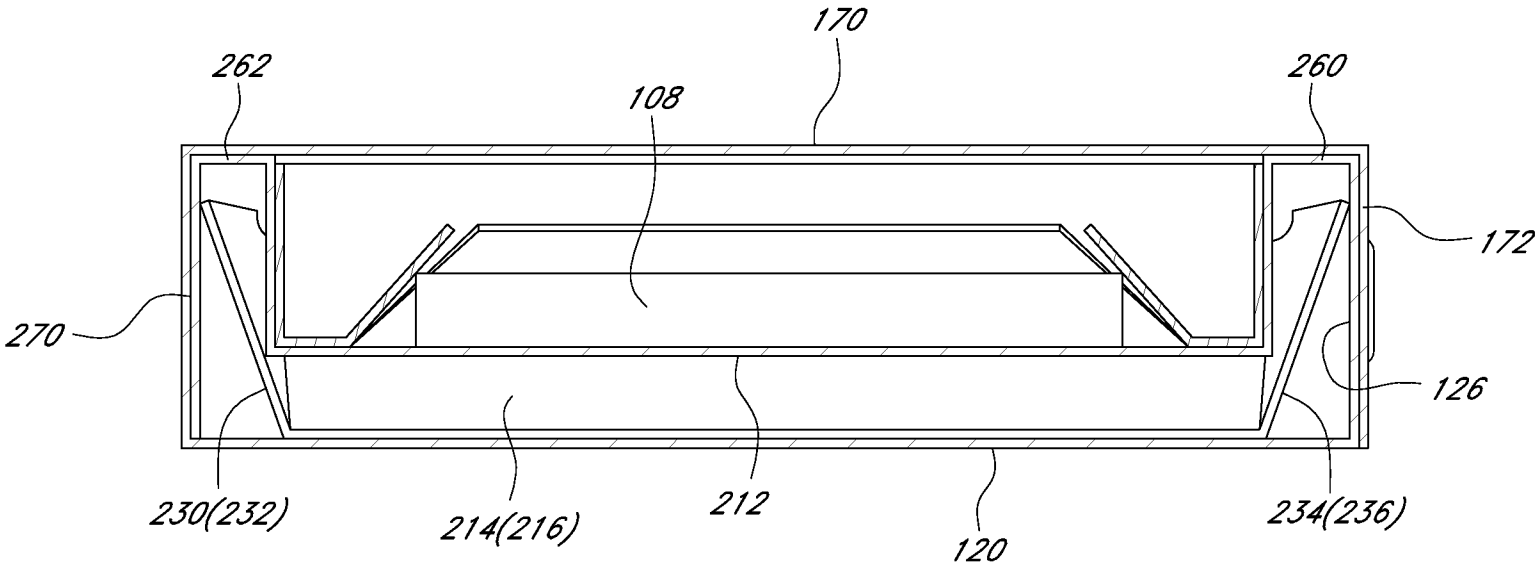
FIG. 13 is a cut-away front elevation view of the packaging assembly with a lid closed, an article being packaged between the first and second suspension supports.

Now referring to FIGS. 1 and 11-13, in one embodiment, when packaging an article 108, the article 108 can be placed over the support panel 212 of the first suspension support 104, and subsequently, the second suspension support 106 can be inserted into the container 102 and placed over the article 108. As can be seen in FIG. 12, the pivotable flaps 364 can be folded to provide resilient support for the article 108. Additionally, the lid 166 can be closed to cover the suspension supports 104, 106 and the article 108. FIGS. 12 and 13 illustrate sectional views of the packaging assembly with the lid 166 closed.

Referring to FIG. 13, in one embodiment, when an impact may be applied to the packaging assembly 100 to urge the article 108 to move in a downward direction, the leg portions 214, 216 can be further folded to decrease the angle $\alpha$. The movement causes the generation of resilient force to support the article 108, and provides cushioning to absorb of such impact. When the article 108 moves down along with the support panel 212, the side panels 222, 224 move down so that the ridge portions 260, 262 are further folded with respect to the end wall 128 and/or the anchor panel 274. The movement further provides cushioning to absorb of such impact.

As can be seen in FIGS. 12 and 13, in one embodiment, when an impact is applied to the packaging assembly 100 to urge the article 108 to move in an upward direction, at least one of the pivotable flaps 364 can be further folded. The movement of the flaps 364 causes the generation of resilient force to support the article 108, and provides cushioning to absorb of such impact.

In one embodiment, when an impact is applied to the packaging assembly 100 to urge the article 108 to move in a horizontal direction, at least one of the pivotable flaps 364 can be further folded. The movement of the flaps 364 causes the generation of resilient force to support the article 108, and provides cushioning to absorb of such impact. Further, as shown in FIG. 13, at least one of the corner panels 230, 232, 234, 236 can be further folded to decrease the clearance between the at least one of the corner panels and one of the side panels 222, 224. The movement causes the generation of resilient force to support the article 108, and provides cushioning to absorb of such impact.

With reference to FIGS. 1, 2 and 7, in one embodiment, the first support panel 212 can include at least one support tab 282. In the illustrated embodiment, each of four support tabs 282 can be formed with a cut line 284 and a fold line 286. Each tab 282 can be folded to an upright position to provide additional support to the article 108 in a horizontal direction.

In some embodiments illustrated in, for example, FIGS. 1 and 13, the assembly can have no resilient retention sheet member formed of, for example, a pliable plastic film, and configured to engage with one of the first and second frames and formed of a pliable plastic film. The assembly can be configured to provide sufficient cushioning without such resilient retention sheet member.

The amount of such cushioning can vary according to the articles maintained in the packaging assembly. In one embodiment, the sufficient cushioning of the packaging assembly that does not use such resilient retention sheet member can be accomplished by determining design parameters of the first frame and second frame. The design parameters can be, for example, size of the leg portions 214, 216, the angle $\alpha$ of the leg portions 214, 216, thickness and characteristics of the board material for forming the first and second frames, size of flaps 364 and the like. These design parameters for sufficient cushioning can be determined by one of ordinary skill in the art through modification of the above-noted design parameters or other design parameters and drop or impact tests. The drop or impact tests can be designed to apply impacts to the packaging assembly maintaining an article in various directions. The magnitude of the impacts can be, for example, 2-5 G (gravities) or more and is determined based on the durability of the article to be packaged in the assembly.

Figure 14:
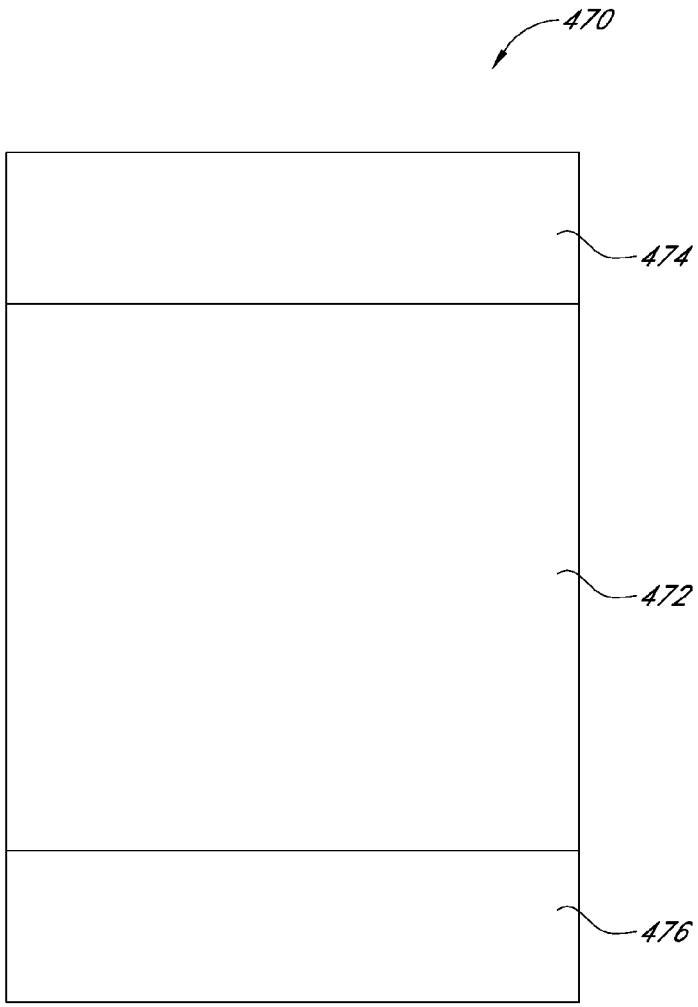
FIG. 14 is a plan view of a retention member having pockets in accordance with one embodiment.
Figure 15:
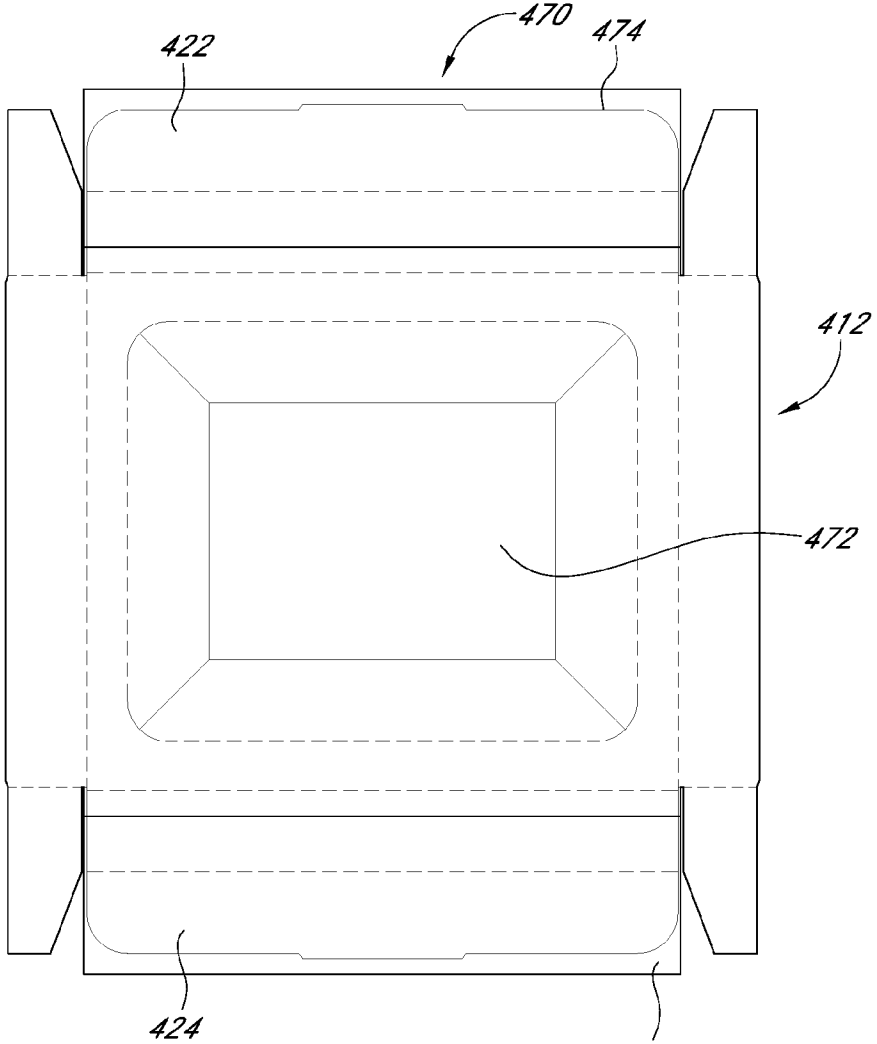
FIG. 15 is a plan view of a sub-assembly of a foldable member and the retention member configured to form a second suspension support in accordance with an embodiment.
Figure 16:
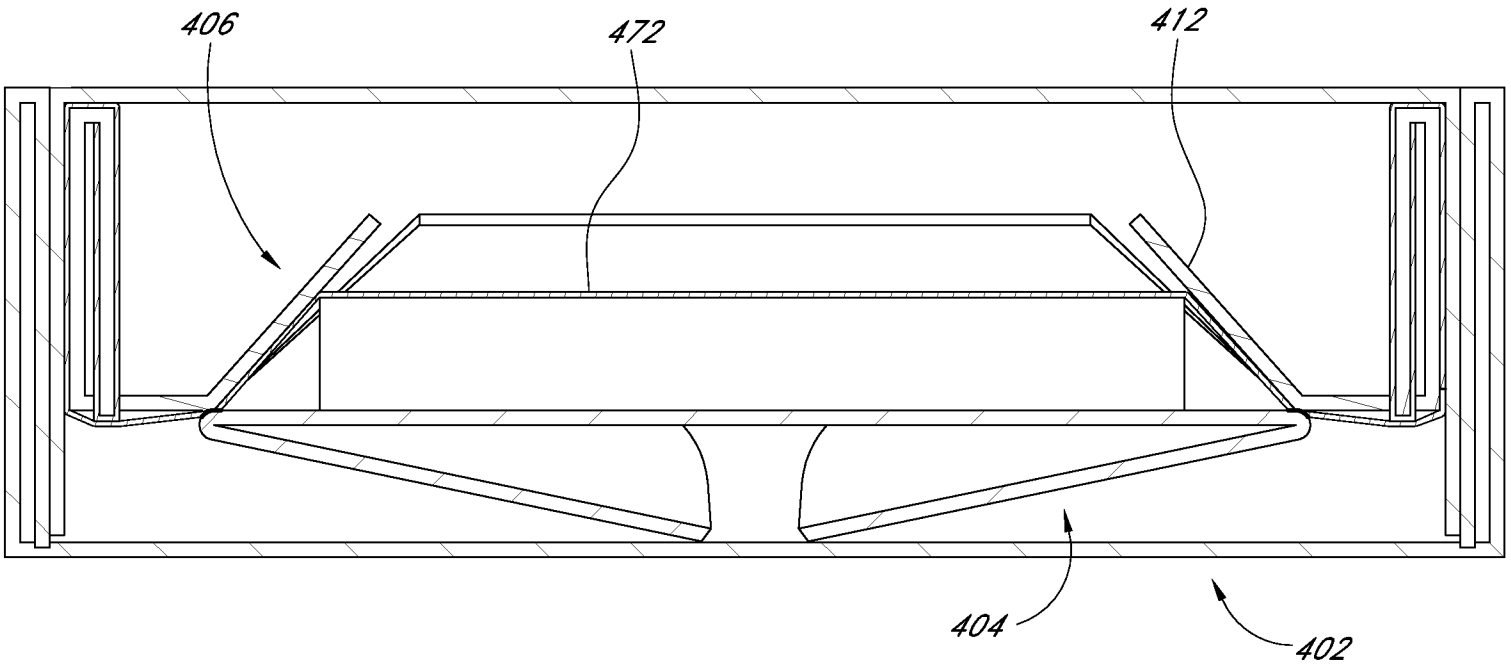
FIG. 16 is a cut-away front elevation view of a packaging assembly in accordance with one embodiment, the second suspension support being formed of the sub-assembly shown in FIG. 15.
Figure 17:
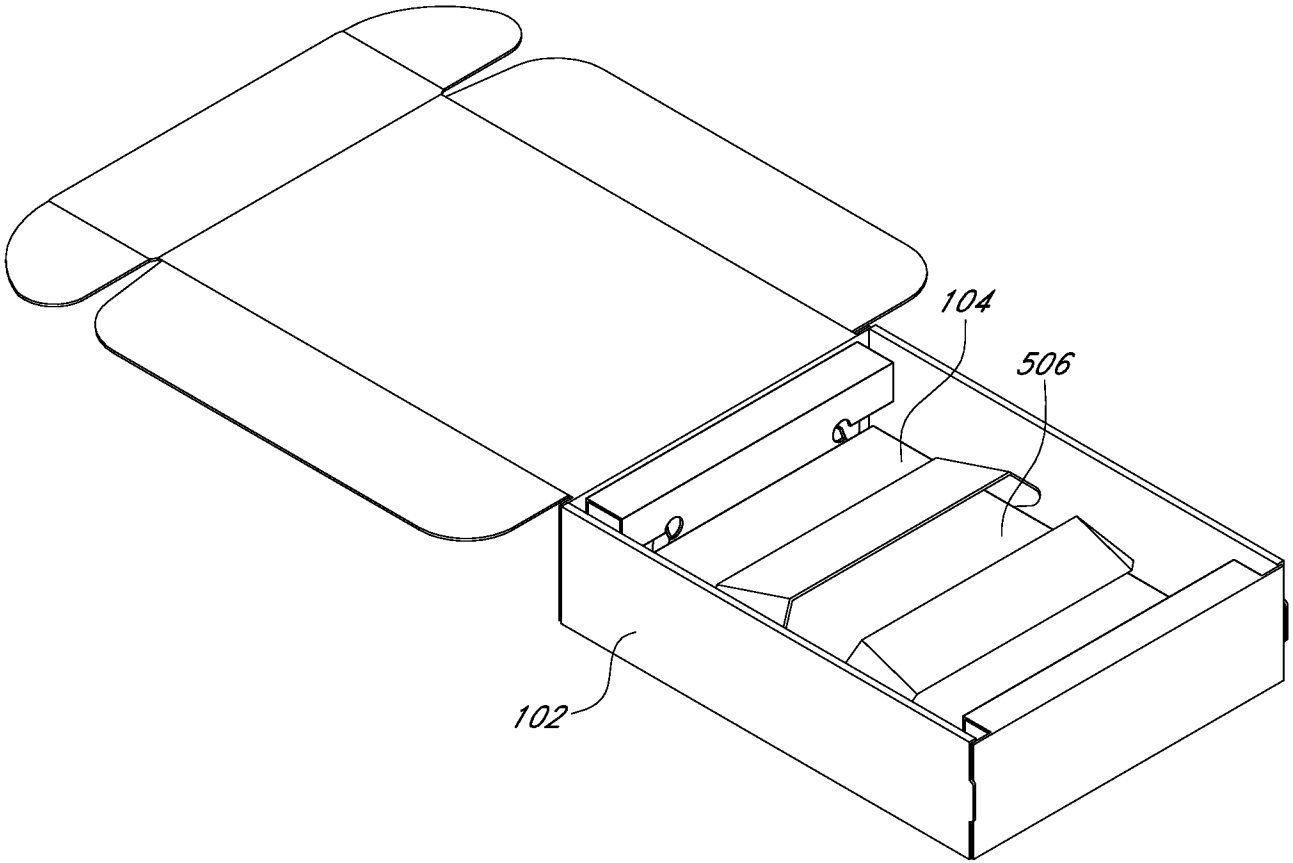
FIG. 17 is a perspective view of a packaging assembly in accordance with one embodiment, an article being located between first and second suspension supports.

FIGS. 14-16 illustrate another embodiment, in which a second suspension support 406 can include a foldable member 412 and optionally a resilient member. It can be understood that a packaging assembly can be maintain an article therein with sufficient cushioning without using an optional resilient member. However, as shown in FIGS. 14-16, a resilient member can be used for providing further cushioning. The assembly 406 of the foldable member 412 and the resilient member can replace the second suspension support 106 used in the embodiments discussed in the above. It can be appreciated by one of the ordinary skilled in the art that a container 402 and a first suspension support 404 having structures same with those of the container 102 and the first suspension support 104 in the foregoing embodiments can be also used in the embodiment.

Referring to FIG. 14, the resilient member in the illustrated embodiment is identified as a retention member 470. The retention member 470 preferably is formed of a resilient body 472. The resilient body 472 also can include pockets 474, 476 at opposite ends thereof. In the illustrated embodiment, the retention member 470 is formed of a single piece of resilient material, and is sized to engage with the foldable member 412 having lateral walls 422, 424. The configuration of the foldable member 412 is same with that of the foldable member 112 discussed above. The retention member 470 can be made of a polyethylene film. However, virtually any polymer, elastomer, or plastic film can be used to form the retention member 470. The density of the film can be varied to provide the desired retention characteristics such as overall strength, resiliency, and vibrational response. Preferably, the density of the retention member 470 is determined such that the retention member 470 is substantially resilient when used to package a desired article.

Referring to FIGS. 14 and 15, in one embodiment, the lateral walls 422, 424 are received in the pockets 474, 476 in an unfolded state of the foldable member 412. Subsequently, the foldable portions of the foldable member 412 are folded in the same manner with that of the foldable member 112 of the embodiment discussed above. When folding the foldable portions of the foldable member 412, the retention member 470 is folded such that the body 472 is placed over an article support panel 402. As shown in FIG. 16, the second suspension support 406 is retained in a container and assembled with a first suspension support 404 to package an article between the first and second suspension supports 404 and 406. When packaged, the body 472 provides additional resilient support in addition to the resilient support of foldable flaps 466.

In some embodiments, a second suspension support can include structures similar to the structures that the first suspension support 104 include as discussed above. For example, a second suspension support can include a base panel and leg panels configured to provide spring effect for resiliently supporting the base panel when folded. FIGS. 17-20 illustrate one embodiment, in which a second suspension support 506 includes a foldable member 508 having a plurality of foldable portions to form a base panel and foldable leg panels. This suspension support can replace the second suspension support 106, 506 used in the foregoing embodiments.

Figure 18:
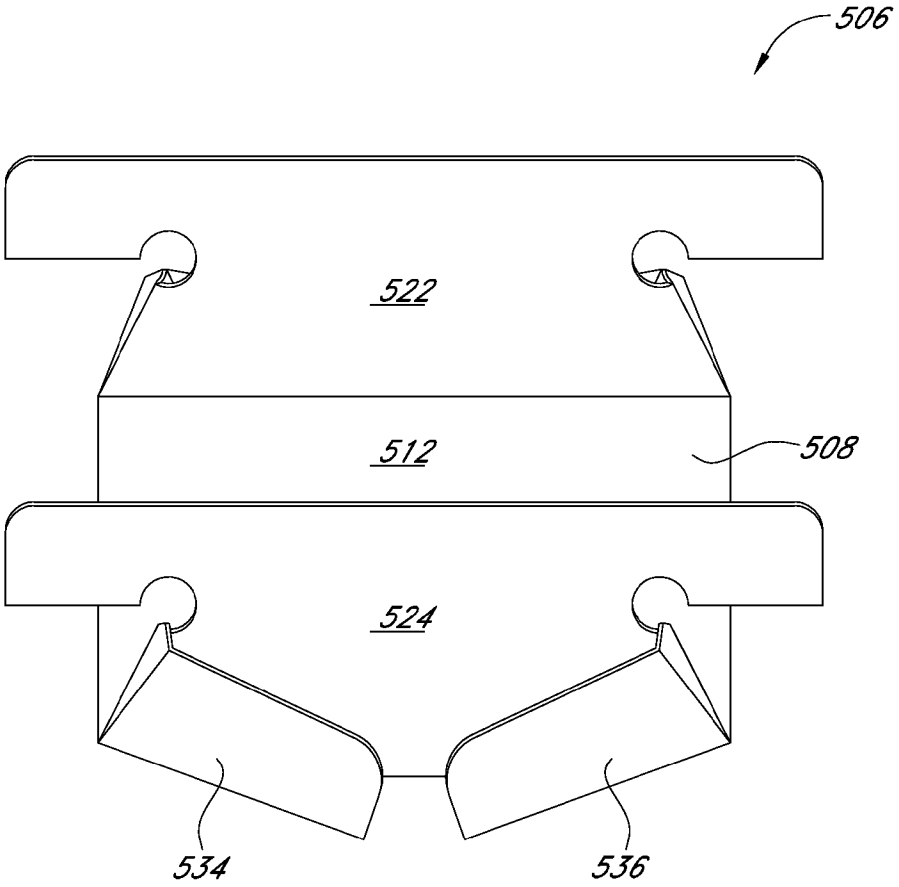
FIG. 18 is a perspective view of the second suspension support shown in FIG. 17.
Figure 19:
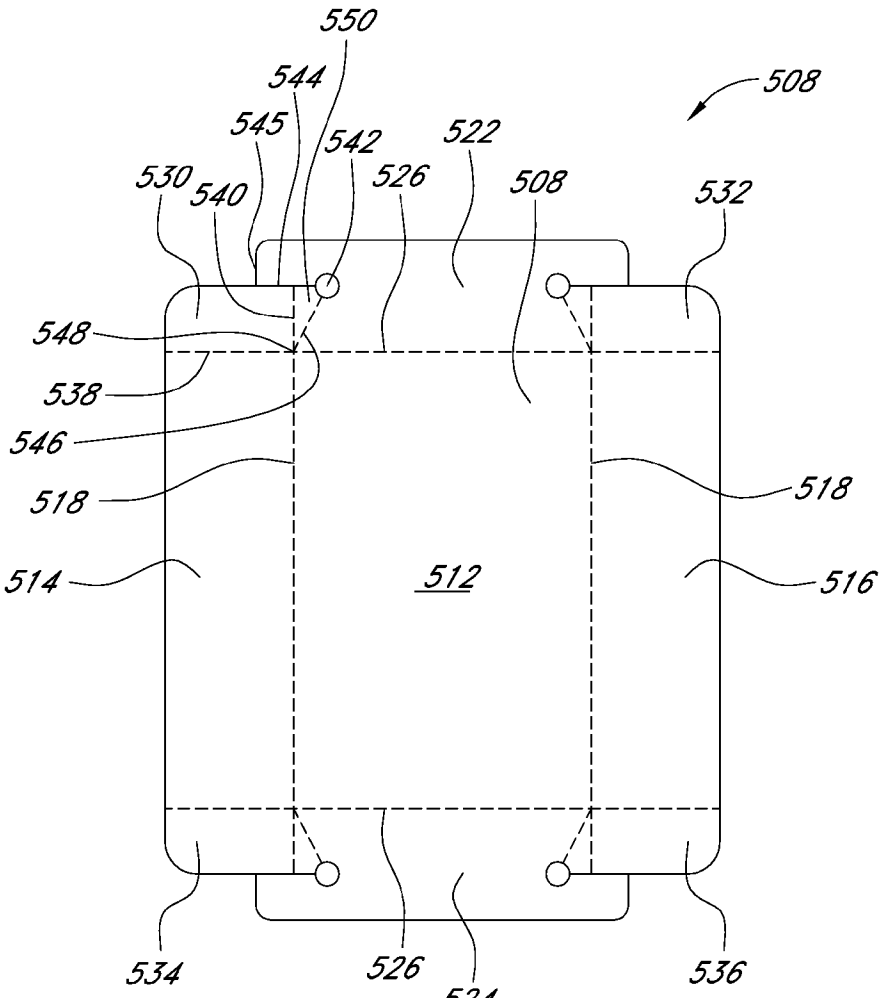
FIG. 19 is a plan view of a foldable member configured to form the second suspension support shown in FIG. 17.

Referring to FIGS. 18 and 19, the second suspension support 506 is formed from a foldable member 508 by folding foldable portions. In one embodiment, the member 508 can be constructed from various materials, including but without limitation, paper, cardboard, corrugated cardboard, plastic, and other appropriate materials. The chosen material for constructing the member 508 can be any substantially rigid but foldable material. It will be appreciated that, although denominated as rigid or substantially rigid, the chosen material would preferably have an amount of flexibility in the cases of extreme physical impact. In some embodiments, the material used to form the member 508 is a single wall corrugated C-flute cardboard.

With continued reference to FIGS. 18 and 19, in one embodiment, the second first suspension support 506 can include a support panel 512 and at least one foldable leg portion pivotally connected to the first article support panel 512. The panel 512 includes a first surface 508 and a second surface 510 opposing the first on which an article to be packaged is disposed. In one embodiment, the first surface 508 faces an article 508 when the article is packaged.

In some embodiments, the second suspension support portion 506 can include two foldable leg portions 514, 516 such that the support base panel 512 is interposed between the leg portions 514, 516. Each of the foldable leg portions 514, 516 is pivotably connected to the support panel 512 along a fold line 518. Each of the leg portions 514, 516 can be folded towards the second surface 510 to form an angle with respect to the second surface 510 smaller than about 90° such that each of the leg portions 514, 516 provides a spring effect.

In one embodiment, the second suspension support 506 can include side panels 522, 524. Each of the side panels 522, 524 is pivotably connected to the support base panel 512 along a fold line 526 such that the base panel 512 is interposed between the side panels 522, 524. Each of the side panels 522, 524 can be folded towards the first surface 508 into a generally perpendicular orientation relative to the base panel 512.

Referring to FIG. 19, in some embodiments, the second suspension support 506 includes corner panels 530, 532, 534, 536. For brevity, the construction related to the corner panel 530 will be described. However, it is to be understood that the packaging assembly includes same features for the corner panels 532, 534, 536. The corner panel 530 is connected to both the leg portion 514 and the side panel 522 along fold lines 538, 540, respectively. In one embodiment, the side panels 522 include a hole 542 located near the corner panel 530. As shown in FIG. 19, a cut line 544 extends from a side edge 545 of the side panel 522 to the hole 542. A further fold line 546 can be formed from a corner 548 of the base panel 512 to the hole 542.

The corner panel 530 can be folded along the fold line 538 towards the side panel 522, to form a first folded state of the corner panel 530 when the leg panel 514 is folded towards the second surface 510 of the base panel 512. In this configuration, the corner panel 530 can form an angle smaller than about 90° with respect to the side panel 522. In one embodiment, the corner panel 530 can be further folded along the fold line 540 to form a second folded state of the corner panel 530 when the side panel 522 is folded towards the first surface of the base panel 512. Additionally, in this folded configuration, a delta-shaped portion 550 of the side panel 522 is configured to be folded along the fold lines 546 with respect to a main portion of the side panel 522. This configuration can allow an edge of the corner panel 530 to be spaced from the side panel 522, and provide a spring effect.

In one embodiment, the foldable leg portions 514, 516 can be folded until leaving a clearance between the foldable portions 514, 516 and the panel 512 with an angle smaller than about 90°. This can provide cushioning for an article 508 when the article 508 is packaged. When folding the leg panels 514, 516, the corner panels 530, 532, 534, 536 can be folded with respect to the side panels 522, 524, too.

Subsequently, the side panels 522, 524 can be folded towards the first surface of the support panel 512 to be approximately perpendicular to the support panel. When folding the side panels 522, 524, the corner panels 530, 532, 534, 536 can be folded with respect to the leg panels 514, 516. Further, the portion 550 can be folded along the fold line 524 and provides a clearance between each of the corner panels 530, 532 and the side panel 522 and between each of the corner panels 534, 536 and the side panel 524.

Figure 20:
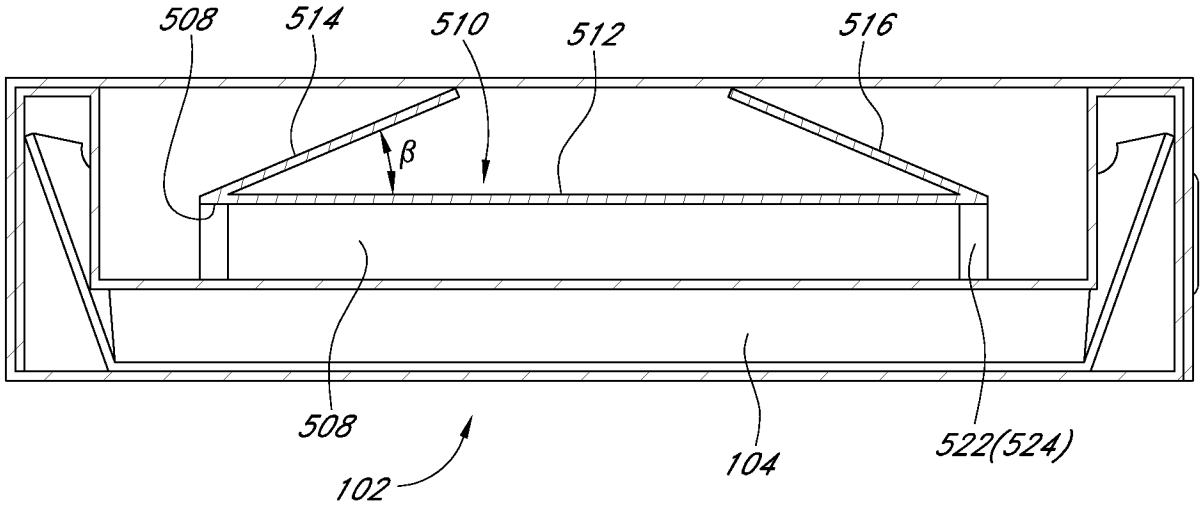
FIG. 20 is a cut-away side elevation view of the packaging assembly shown in FIG. 17 with a lid closed, an article being located between the first and second suspension supports.

As shown in FIG. 20, in one embodiment, an article 508 is retained between the first and second suspension supports 504, 506. When assembled, the legs 514, 516 can be positioned between the support panel 512 and the lid 520 of the container 502. In some embodiments, edges of the leg portions 514, 516 contact the top of the container 502 so that the legs 514 resiliently urge the support panel 512 to support an article that will be disposed between the support panel 511 of the first suspension support 502 and the support panel 512 of the second suspension support 502. In some embodiments, at least a portion of each of the corner panels 530, 532 can be interposed between one of the side panel 522 and the lateral wall 552. Edges of the corner panels 530, 532 contact the lateral wall 554. Similarly, in some embodiments, at least a portion of each of the corner panels 534, 536 can be interposed between one of the side panel 522 and the lateral wall 556. In the illustrated embodiment, edges of the corner panels 530, 532 contact the lateral wall 556.

Referring to FIG. 20, in one embodiment, when an impact may be applied to the packaging assembly 500 to urge the article 508 to move in an upward direction, the leg portions 514, 516 can be further folded to decrease the angle β. The movement causes the generation of resilient force to support the article 508, and provides cushioning to absorb of such impact. In one embodiment, when an impact is applied to the packaging assembly 500 to urge the article 508 to move in a horizontal direction, at least one of the corner panels 530, 532, 534, 536 can be further folded to decrease the clearance between the at least one of the corner panels and one of the lateral walls 552, 554. The movement causes the generation of resilient force to support the article 508, and provides cushioning to absorb of such impact.

Figure 21:
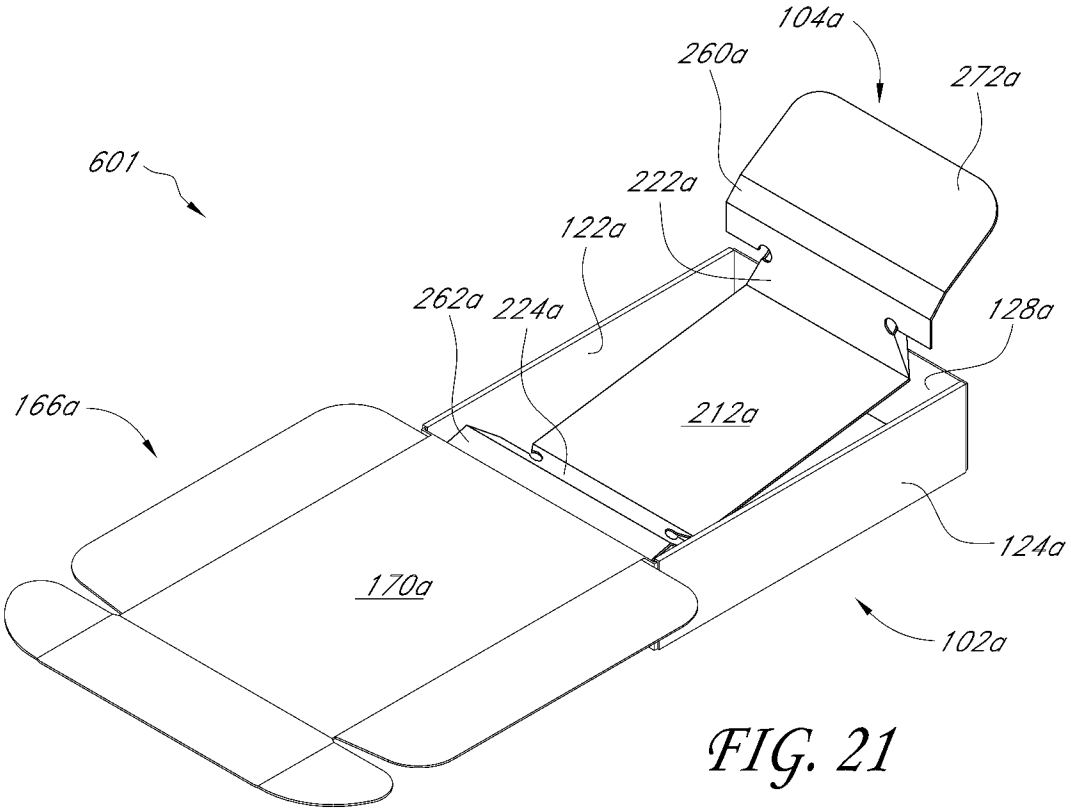
FIG. 21 is a perspective view of a sub-assembly of a packaging assembly in accordance with one embodiment, illustrating that a first suspension support is being folded and inserted into a container.
Figure 22:
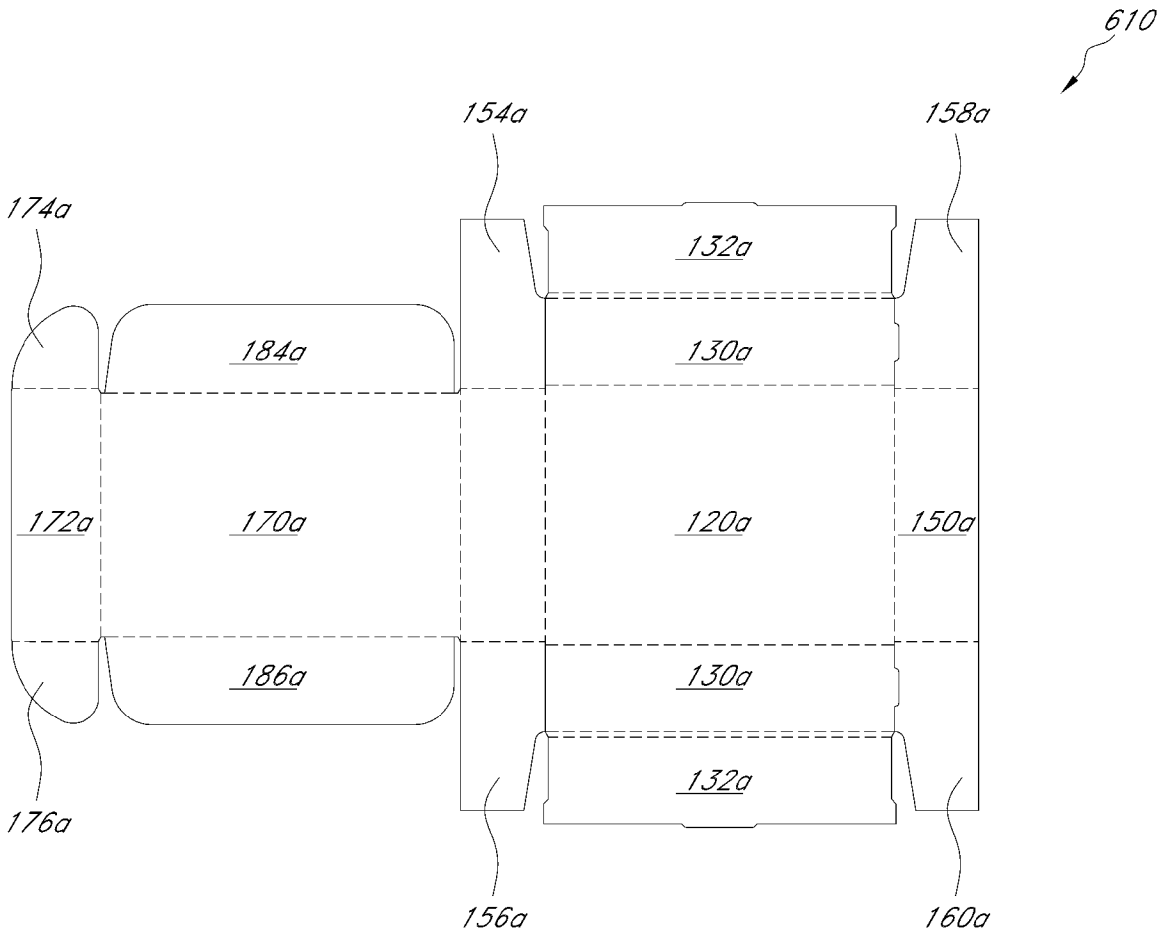
FIG. 22 is a plan view of a foldable member configured to form the container member of the sub-assembly shown in FIG. 20.

With reference to FIGS. 21-24, a modification of the embodiment shown in FIGS. 1-13 will be described. As shown in FIGS. 21-24, a foldable member 610 can include foldable portions configured to form a container 102*a*. A foldable member 611 includes foldable portions configured to form a first suspension support 104*a*. The container 102*a* receives the first suspension support 104*a* to form a subassembly 601. As shown in FIGS. 21-24, the container 102*a* is constructed substantially identical to the container 102 shown in FIGS. 1-7 and 10-13 except that the container 102 is foldable connected to the first suspension support 104 as shown in FIGS. 1-7 and 10-13 while the container 102*a* is not integrated with the first suspension support 104*a* as shown in FIGS. 21-22. Thus, the reference numerals used to designate the various components,for example, components 120*a*, 122*a*,124*a*, 130*a*, 132*a*, 150*a*, 154*a*, 156*a*, 158*a*, 160*a*, 166*a*, 170*a*, 172*a*, 174*a*, 176*a*, 184*a*, and 186*a*, of the container 102*a* are identical to those used for identifying the corresponding components of the container 102 in FIGS. 1-7 and 10-13, except that an "a" has been added to the reference numerals. The above description applies equally to the common elements unless otherwise indicated. Therefore, a further description of the container 102*a* is not necessary for one of ordinary skilled in the art to practice the invention.

As shown in FIGS. 21-24, the first suspension support 104*a* is constructed similarly to the first suspension support 104 shown in FIGS. 1-7 and 10-13 except as noted below. Thus, the reference numerals used to designate the various components, for example, componenets 212*a*, 214*a*, 216*a*, 222*a*, 224*a*, 230*a*, 232*a*, 234*a*, and 236*a*, of the first suspension support 104*a* are identical to those used for identifying the corresponding components of the first suspension support 104 in FIGS. 1-7 and 10-13, except that an "a" has been added to the reference numerals. The above description applies equally to the common elements unless otherwise indicated. Therefore, a further description of the common elements is not necessary for one of ordinary skilled in the art to practice the invention. However, anchor panels will further be described below.

Figure 23:
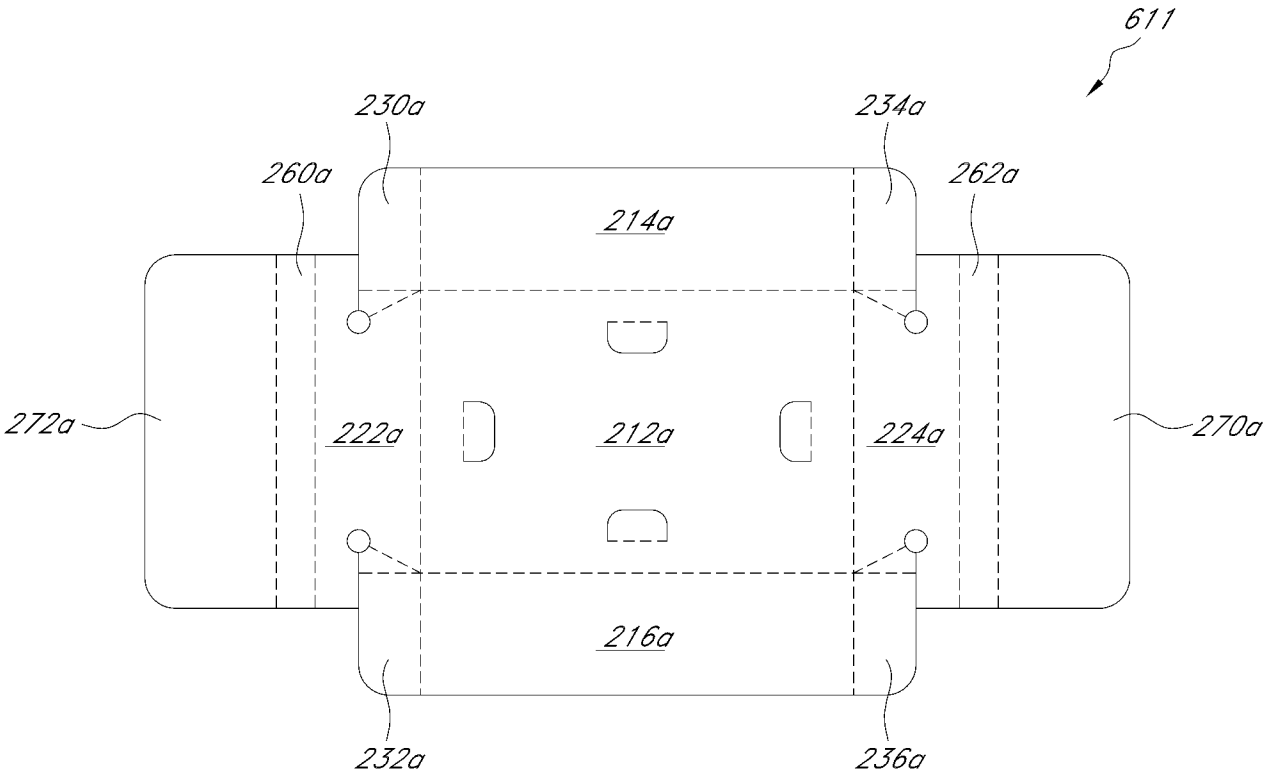
FIG. 23 is a plan view of a foldable member configured to form the first suspension support of the sub-assembly shown in FIG. 20, showing the unfolded state thereof.
Figure 24:
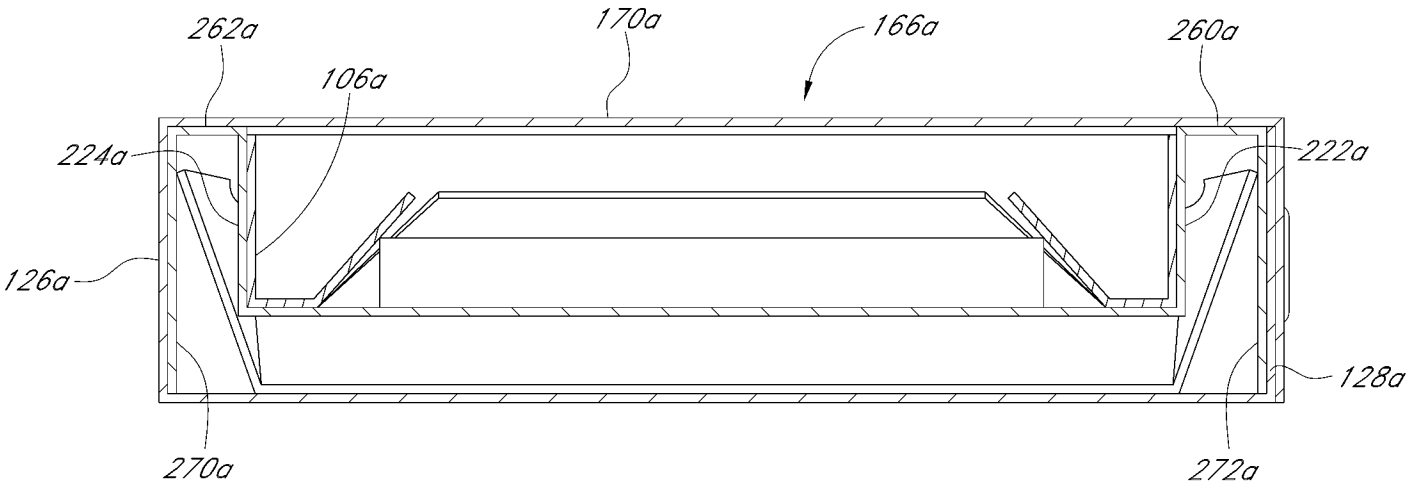
FIG. 24 is a cut-away side elevation view of the packaging assembly including the container and the suspension supports shown in FIG. 21 with a lid closed, an article being located between first and second suspension supports.

With reference to FIGS. 21, 23 and 24, in one embodiment, the first suspension support 104*a* can further include foldable anchor panels 270*a*, 272*a* that are connected to the ridge panels 262*a*, 260*a* along a fold line 274*a*, 276*a*, respectively. In some embodiments, the ridge portions 262*a* and the anchor panel 270*a* can be folded towards the side panel 224*a* such that the anchor 270*a* and the side panel 224*a* are generally parallel to each other. Similarly, the ridge portions 260*a* and the anchor panel 272*a* can be folded towards the side panel 222*a* such that the anchor 272*a* and the side panel 222*a* are generally parallel to each other. As shown in FIG. 21, in one embodiment, the anchor panel 272*a* can be folded while the first frame 104*a* is being received in the container 102*a*. In some embodiments, the frame 104*a* can be received in the container 102*a* once the folding of the foldable portions of the support 104*a* is completed.

With reference to FIG. 24, once the folded formation of the first suspension support 104*a* is completed and received in the container 102*a*, the anchor panel 272*a* is located between the end wall 128*a* and the side panel 222*a*, while the anchor panel 270*a* is located between the end wall 126*a* and the side panel 224*a*. The anchor panels 270*a*, 272*a* aid in anchoring the position of the first support 104*a* in the container.

FIG. 24 illustrates an embodiment, in which a second suspension support 106*a* constructed substantially identically to the second suspension support 106 shown in FIG. 1 can be used, but not limited thereto. It can be easily understood by one of the ordinary skilled in the art that other second suspension supports shown in FIGS. 14-20 can be used.

Although the present inventions have been described in terms of certain embodiments, other embodiments apparent to those of ordinary skilled in the art also are within the scope of these inventions. Thus, various changes and modifications may be made without departing from the spirit and scope of the inventions. For instance, various components may be repositioned as desired. Moreover, not all of the features, aspects and advantages are necessarily required to practice the present inventions.

What is claimed is:

1. A packaging assembly for packaging an article and maintaining the article therein, the assembly comprising:

a container comprising a top, a bottom and a plurality of sidewalls;

a first frame contained within the container, the first frame comprising:

a first support panel comprising a first surface configured to face an article and a second surface opposite to the first surface, wherein the first panel comprises a substantially rigid portion over which the article is to be placed such that the first support panel can support the article without any resilient retention sheet member engaged with the first frame, and a first leg portion pivotably connected to the first support panel and located between the first support panel and the bottom, wherein the first leg portion is rotatable relative to the first support panel between a first rotational position and a second rotational position so as to allow movement of the first support panel relative to the bottom, wherein the first leg portion is configured to cause a resilient force to bias the first support panel away from the bottom when the first leg portion is located at a third rotational position between the first rotational position and the second rotational position, at least two side panels opposing each other, connected to the first support panel and extending toward the top of the container;

a first connecting portion, the first connecting portion interconnecting the first support panel and the container and comprising a fold line configured to allow movement of the first support panel relative to the bottom of the container; and a second frame comprising a second support panel and contained within the container, the second frame being configured to be received in and fitting within a space between the at least two side panels of the first frame so as to retain the article between the first and second support panels, the second frame being configured to support the article without any resilient retention sheet member engaged with the second frame.

2. The assembly of claim 1, wherein the first frame further comprises:

a first anchor panel extending between the top and bottom of the container; and a second connecting portion interconnecting the first support panel and the first anchor panel and comprising at least one fold line configured to allow movement of the first support panel relative to the bottom of the container.

3. The assembly of claim 2, wherein the second connecting portion comprises at least two panels pivotably connected to each other along the at least one fold line.

4. The assembly of claim 2, wherein the second connecting portion comprises a at least one of the at least two side panels pivotally connected to the first support panel, and a ridge panel pivotably connected to each of the first anchor panel and the at least one of the at least two side panels, wherein the first anchor panel and the at least one of the at least two side panels are substantially parallel to each other.

5. The assembly of claim 2, wherein the first frame further comprises:

a second anchor panel extending between the top and the bottom of the container; and a second connecting portion interconnecting the first support panel and the second anchor panel and comprising at least one fold line configured to allow movement of the first support panel relative to the bottom of the container.

6. The assembly of claim 2, wherein the first frame further comprises a second connecting portion interconnecting the first support panel and one of the plurality of sidewalls of the container and comprising at least one fold line configured to allow movement of the first support panel relative to the bottom of the container.

7. The assembly of claim 1, wherein the first leg portion comprises a distal end contacting the bottom and configured to slide with respect to the bottom when the first leg portion moves between the first and second rotational positions.

8. The assembly of claim 1, wherein the first frame further comprises a second leg portion pivotably connected to the first support panel such that the first support panel is interposed between the first and second leg portions.

9. The assembly of claim 1, wherein the second support panel of the second frame comprises at least one foldable flap configured to resiliently support an article retained between the first and second frames.

10. The assembly of claim 1, wherein the assembly has no resilient retention sheet member configured to engage with one of the first and second frames.

11. The assembly of claim 1, where the assembly is configured to provide substantial cushioning without a resilient retention sheet member configured to engage with one of the first and second frames.

12. The assembly of claim 1, wherein the second frame comprises a third leg portion pivotably connected to the second support panel and located between the second support panel and the top, wherein the third leg portion is rotatable relative to the second support panel between a first rotational position and a second rotational position so as to allow movement of the second support panel relative to the top, wherein the third leg portion is configured to cause a resilient force to bias the second support panel away from the top when the third leg portion is located at a third rotational position between the first rotational position and the second rotational position.

13. The assembly of claim 1, wherein the container and the first frame are pivotably connected to each other and are formed of a single cardboard.

14. A packaging kit for packaging an article and maintaining the article, the kit comprising:

a container forming member comprising a plurality of foldable portions configured to form a container which comprises a top, a bottom and a plurality of sidewalls;

a first frame forming member comprising a plurality of foldable portions configured to form a first frame to be contained within the container, wherein the first frame comprises:

a first support panel comprising a first surface configured to face an article and a second surface opposite to the first surface, wherein the first panel comprises a substantially rigid portion over which the article is to be placed such that the first support panel can support the article without any resilient retention sheet member engaged with the first frame, and a first leg portion pivotably connected to the first support panel and configured to be located between the first support panel and the bottom, wherein the first leg portion is rotatable relative to the first support panel between a first rotational position and a second rotational position so as to allow movement of the first support panel relative to the bottom, wherein the first leg portion is configured to cause a resilient force to bias the first support panel away from the bottom when the first leg portion is located at a third rotational position between the first rotational position and the second rotational position, at least two side panels opposing each other, connected to the first support panel and extending toward the top of the container;

a connecting portion, the connecting portion interconnecting the first support panel and the container and comprising a fold line configured to allow movement of the first support panel relative to the bottom of the container; and a second frame forming member comprising a plurality of foldable portions and configured to form a second frame which is to be contained within the container and comprises a second support panel and at least one side panel connected to the second support panel, the second frame being configured to be received in and fitting within a space between the at least two side panels of the first frame so as to retain an article between the first and second support panels, the second frame being configured to support the article without any resilient retention sheet member engaged with the second frame.

15. The kit of claim 14, wherein the first frame further comprises:

a first anchor panel extending between the top and bottom of the container when the first frame is contained in the container; and a second connecting portion interconnecting the first support panel and the first anchor panel and comprising at least one fold line configured to allow movement of the first support panel relative to the bottom of the container.

16. The kit of claim 15, wherein the second connecting portion comprises a at least one of the at least two side panels pivotally connected to the first support panel and a ridge panel pivotably connected to each of the first anchor panel and the at least one of the at least two side panels, wherein the first anchor panel and the at least one of the at least two side panels are substantially parallel to each other.

17. The kit of claim 15, wherein the first frame further comprises:

a second anchor panel extending between the top and the bottom of the container when the first frame is contained in the container; and a second connecting portion interconnecting the first support panel and the second anchor panel and comprising at least one fold line configured to allow movement of the first support panel relative to the bottom of the container.

18. The kit of claim 14, wherein the kit has no resilient retention sheet member configured to engage with one of the first and second frames.

19. The kit of claim 14, where the kit is configured to form a packaging assembly for packaging and maintaining the article therein, wherein the assembly is configured to provide substantial cushioning without a resilient retention sheet member configured to engage with one of the first and second frames.

20. A packaging assembly for packaging an article and maintaining the article therein, the assembly comprising:

a container comprising a top, a bottom and a plurality of sidewalls;

a first frame contained within the container, the first frame comprising:

a first support panel comprising a first surface configured to face an article and a second surface opposite to the first surface, wherein the first panel comprises a substantially rigid portion over which the article is to be placed such that the first support panel can support the article without any resilient retention sheet member engaged with the first frame, and a first leg portion pivotably connected to the first support panel and located between the first support panel and the bottom, wherein the first leg portion is rotatable relative to the first support panel between a first rotational position and a second rotational position so as to allow movement of the first support panel relative to the bottom, wherein the first leg portion is configured to cause a resilient force to bias the first support panel away from the bottom when the first leg portion is located at a third rotational position between the first rotational position and the second rotational position, at least two side panels opposing each other, connected to the first support panel and extending toward the top of the container;

a first connecting portion, the connecting portion interconnecting the first support panel and the container and comprising a fold line configured to allow movement of the first support panel relative to the bottom of the container;

a first anchor panel extending between the top and bottom of the container;

a second connecting portion interconnecting the first support panel and the first anchor panel and comprising at least one fold line configured to allow movement of the first support panel relative to the bottom of the container;

a second anchor panel extending between the top and the bottom of the container;

a third connecting portion interconnecting the first support panel and the second anchor panel and comprising at least one fold line configured to allow movement of the first support panel relative to the bottom of the container; and a second frame comprising a second support panel and contained within the container, the second frame being configured to be received in and fitting within a space between the at least two side panels of the first frame so as to retain the article between the first and second support panels, the second frame being configured to support the article without any resilient retention sheet member engaged with the second frame.

* * * * *